US007517040B2

(12) United States Patent
Takata

(10) Patent No.: US 7,517,040 B2
(45) Date of Patent: Apr. 14, 2009

(54) LIQUID EJECTION APPARATUS WITH PLURAL HEATING ELEMENTS

(75) Inventor: Takuya Takata, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 456 days.

(21) Appl. No.: 11/385,783

(22) Filed: Mar. 22, 2006

(65) Prior Publication Data

US 2006/0214962 A1 Sep. 28, 2006

(30) Foreign Application Priority Data

Mar. 23, 2005 (JP) ..... 2005-084561

(51) Int. Cl.
*B41J 29/38* (2006.01)
*B41J 2/155* (2006.01)

(52) U.S. Cl. ..... 347/14; 347/42

(58) Field of Classification Search ..... 347/17, 347/120, 14, 42

See application file for complete search history.

(56) References Cited

U.S. PATENT DOCUMENTS 7,207,641 B2 * 4/2007 Komatsu et al. ..... 347/17
2005/0052485 A1 * 3/2005 Komatsu et al. ..... 347/17

FOREIGN PATENT DOCUMENTS

EP 838332 A2 * 4/1998
JP 10-193597 A 7/1998

* cited by examiner

*Primary Examiner*—Julian D Huffman
*Assistant Examiner*—Carlos A Martinez, Jr.
(74) *Attorney, Agent, or Firm*—BIrch, Stewart, Kolasch & Birch LLP

(57) ABSTRACT

A liquid ejection head having a plurality of ejection elements with liquid ejecting nozzles arranged in a matrix along a row direction and in a column direction which is substantially parallel to a sub-scanning direction along which either the head or a liquid ejection receiving medium is moved. Each group of ejection elements forming each column of the matrix having a heating element that is as long as the length of that column and that can heat the liquid prior to ejection. A prediction device predicts a number of the ejection elements to be driven in each of the column groups according to ejection data and a heating control device independently controls the heating elements of each column group according to the number of the ejection elements to be driven in that column group as predicted by the prediction device.

10 Claims, 29 Drawing Sheets

LIQUID EJECTION APPARATUS WITH PLURAL HEATING ELEMENTS

BACKGROUND OF THE INVENTION

1. Field of the Invention

The present invention relates to a liquid ejection apparatus, and more particularly, to a liquid ejection apparatus and control technology for a liquid ejection head suitable for same, which ejects liquid onto an ejection receiving medium by using a liquid ejection head having pressure generating elements corresponding to a plurality of nozzles.

2. Description of the Related Art

In general, in an inkjet recording apparatus, ink droplets are ejected at prescribed timings, respectively, from a plurality of nozzles of a head, on the basis of the dot pattern data (also called "dot data" or "print data") developed from image data for printing which has been input from a host computer, and printing is carried out by means of these ink droplets landing on and adhering to a medium, such as recording paper.

In particular, in single-pass recording in which an image is recorded by means of a single relative scanning action on a medium by a line head having a nozzle row of a length corresponding to the breadthways direction of the medium, there are nozzles that frequently perform ink ejection, and nozzles that hardly perform ink ejection, at respective locations within the head. In the nozzles that hardly perform ink ejection, a viscosity change (viscosity increase) occurs in the ink inside these nozzles, and it becomes difficult to eject ink from the nozzles. In order to avoid problems of this kind, methods have been proposed whereby ejection is controlled in such a manner that the drive signals for the piezoelectric elements are varied in accordance with external conditions (environmental conditions) and ejection conditions (ejection state), and the ink temperature is measured and the ink temperature inside the head is controlled by a heater on the basis of the measured temperature, so that it remains uniform.

Japanese Patent Application Publication No. 10-193597 discloses an inkjet recording head having a plurality of channels which are mutually parallel and separated by partitions of piezoelectric ceramic, in which the partitions are caused to deform by means of a drive voltage, thereby causing the ink filled in the channels to be ejected selectively from the nozzles. Electrical heating bodies are provided in recess sections formed extending in a substantially perpendicular direction to the channels, on the reverse side of the piezoelectric ceramic partitions from the side adjacent to the channels. The ink filled in the channels is kept to a prescribed temperature by means of the electrical heating bodies.

However, in cases where various functions are imparted to the ink, or where it is sought to achieve high performance in the ink, the viscosity of the ink often increases. When ejecting high-viscosity ink of this kind, a drive signal having a waveform with a high drive voltage, sharp rise and sharp fall is required, compared to a case where an ink of general viscosity (lower viscosity than high-function, high-performance ink) is ejected. Consequently, the drive circuit for the ejection elements must be compatible with high-voltage and high-current operation, while at the same time, it must also be compatible with a short ejection cycle (high ejection frequency), which has an inverse relationship with high voltage and current.

In a head having a very large number of nozzles, such as a line head, even if the drive signals to be supplied to the piezoelectric elements are adjusted in accordance with the external environment, there is a possibility that locally situated nozzles having low ejection frequencies are not suitably cared. This situation is particularly notable in the case of high-viscosity ink which has a higher viscosity than generally used ink. Moreover, when the drive signals are adjusted in accordance with the ejection conditions, then not only does the ejection control procedure become complicated, but also, the scale of the wiring which transmits the drive signals and the scale of the drive circuit for generating the drive signals increases. Furthermore, if a heater and a temperature measurement sensor are provided for each nozzle, then there is a problem in that the head, the heater drive circuit and the sensor circuits all increase in size. When seeking to achieve high-speed through-put, as in a line head, then if the response of the temperature sensors is poor, it takes time to measure the temperature and satisfactory temperature control may not be possible.

In the inkjet recording head described in Japanese Patent Application Publication No. 10-193597, it is difficult to arrange the nozzles two-dimensionally, and there are limitations on increasing the nozzle density.

SUMMARY OF THE INVENTION

The present invention has been contrived in view of the foregoing circumstances, an object thereof being to provide a liquid ejection apparatus which achieves desirable liquid ejection by avoiding local ejection abnormalities in a liquid ejection head having a large number of nozzles.

In order to attain the aforementioned object, the present invention is directed to a liquid ejection apparatus, comprising: a liquid ejection head including: a plurality of ejection elements arranged in a row direction coinciding with a main scanning direction and in a column direction which is substantially parallel to a sub-scanning direction, each of the ejection elements having a nozzle which ejects liquid onto an ejection receiving medium and having a piezoelectric element which applies an ejection force to the liquid to be ejected from the nozzle, the ejection elements forming groups of the ejection elements, each of the groups of the ejection elements being constituted by the ejection elements arranged in the column direction; and a plurality of heating elements which heat the liquid to be ejected from the nozzles and are arranged in the row direction correspondingly to the groups of the ejection elements, each of the heating elements having a length in the column direction substantially equal to or greater than a length of each of the groups of the ejection elements; a movement device which moves the ejection receiving medium in the sub-scanning direction relatively to the liquid ejection head, by moving at least one of the ejection receiving medium and the liquid ejection head; a heating element drive device which applies a heating drive signal to each of the heating elements; a prediction device which predicts a number of the ejection elements to be driven in each of the groups of the ejection elements, according to ejection data; and a heating control device which varies and controls an amount of heat generated by each of the heating elements, according to the number of the ejection elements to be driven in each of the groups of the ejection elements, as predicted by the prediction device.

According to the present invention, the number of driven elements to be driven in each of the ejection element groups arranged in a substantially parallel direction to the conveyance direction of the ejection receiving medium is predicted, and the amount of heat generated by the heating devices provided so as to correspond to the respective driven element groups is varied in accordance with the number of driven elements thus predicted. Therefore, it is possible to control the temperature of the liquid in each of the ejection element groups, even without providing a temperature measurement device for measuring the temperature in each of the ejection elements or each of the ejection element groups. Furthermore, it is possible to reduce the processing load on the control system, in comparison with a mode in which the temperature is measured at occasional intervals, and moreover, the number of heating elements can be reduced and costs can be lowered, in comparison with a mode in which heating devices are provided respectively for the ejection elements.

A compositional embodiment of the "liquid ejection apparatus" according to the present invention is an inkjet recording apparatus comprising a full line type inkjet head having a nozzle row in which a plurality of nozzles for ejecting ink are arranged through a length corresponding to the full width of the ejection receiving medium.

In this case, a mode may be adopted in which a plurality of relatively short liquid ejection head blocks having nozzles rows which do not reach a length corresponding to the full width of the ejection receiving medium are combined and joined together, thereby forming a long liquid ejection head block and configuring nozzle rows of a length that correspond to the full width of the ejection receiving medium.

A full line type liquid ejection head (inkjet head) is usually disposed in a direction perpendicular to the relative feed direction (relative conveyance direction) of the ejection receiving medium, but modes may also be adopted in which the inkjet head is disposed following an oblique direction that forms a prescribed angle with respect to the direction perpendicular to the relative conveyance direction.

Furthermore, ink for forming (recording) color images onto the ejection receiving medium is included in the liquid ejected from the liquid ejection head.

The direction substantially parallel to the conveyance direction of the ejection receiving medium may also include a direction forming a prescribed angle of θ with respect to the conveyance direction of the ejection receiving medium.

The term "ejection receiving medium" indicates a medium on which an image is recorded by means of the action of the liquid ejection head (this medium may also be called an recording medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The movement device for causing the ejection receiving medium and the liquid ejection head to move relatively to each other may include a mode where the ejection receiving medium is conveyed with respect to a stationary (fixed) liquid ejection head, or a mode where a liquid ejection head is moved with respect to a stationary ejection receiving medium, or a mode where both the liquid ejection head and the ejection receiving medium are moved.

A heater (resistor) which generates heat corresponding to a drive voltage when a prescribed drive signal (drive voltage) is applied to same is suitable for use as the heating element of the present invention. This heating element may be disposed in the nozzle of the ejection element or in the vicinity of same, in the pressure chamber which accommodates the liquid to be ejected from the nozzle, or in the supply side flow channel which supplies the liquid to the pressure chamber.

Furthermore, the heating element drive device includes a waveform generation unit which generates a heating drive signal waveform, an amplification unit which amplifies this waveform at a prescribed gain, and a power amplification unit which amplifies the power of the heating drive signal amplified by the amplification unit.

Preferably, the liquid ejection apparatus further comprises: a temperature setting device which sets a target temperature of the liquid ejected from the nozzles, wherein the heating control device controls the heating elements in such a manner that a temperature of the liquid ejected from the nozzles becomes the target temperature set by the temperature setting device.

Since the liquid ejected from the nozzles is controlled to the prescribed target temperature, desirable liquid ejection is achieved. Desirably, this target temperature is changed in accordance with the type of liquid and the type of ejection receiving medium.

Preferably, the heating control device controls the heating elements in such a manner that the amount of heat generated by each of the heating elements disposed in end regions of the liquid ejection head in the row direction is greater than the amount of heat generated by each of the heating elements disposed in an approximate center region of the liquid ejection head.

In particular, in a liquid ejection head in which a plurality of nozzles are arranged through a length corresponding to the width of the ejection receiving medium, the surface area exposed to the atmosphere is greater at the end regions of the liquid ejection head than in the approximate center region of the head, and therefore, the heat radiation effects are greater in the end regions. Hence, there is a tendency for the temperature of the liquid in the end regions and the vicinity thereof to be lower than the liquid in the approximate center region of the head. In a state of this kind, ejection non-uniformities (shading) may occur in the liquid ejected onto the ejection receiving medium. Therefore, by increasing the amounts of heat generated by the heating elements in the end regions compared to the heating elements in the approximate center region, it is possible to keep the temperature of the liquid inside the liquid ejection head uniform, irrespective of the positions within the ejection receiving medium. Consequently, desirable liquid ejection can be performed from all of the nozzles of the liquid ejection head, and therefore, ejection non-uniformities on the ejection receiving medium can be suppressed.

Preferably, the liquid ejection apparatus further comprises: a temperature distribution prediction device which predicts a temperature distribution in the liquid ejection head, wherein the heating control device controls the heating elements in such a manner that the temperature distribution predicted by the temperature distribution prediction device is compensated.

If there is a temperature distribution in the head and the liquid inside the head, then it becomes impossible to maintain a prescribed ejection state (ejection volume, ejection direction) in the nozzles in the regions of lower temperature. Therefore, if this temperature distribution is compensated by controlling the liquid inside the liquid ejection head in such a manner that the liquid comes within a prescribed temperature range throughout the whole of the liquid ejection head, then it is possible to achieve desirable liquid ejection from all of the nozzles of the liquid ejection head.

A composition is possible in which a temperature history (temperature profile) for compensating the temperature distribution is previously stored in a storage device with respect to a number of different temperature distributions, and the temperature history corresponding to the predicted temperature distribution can be read out from this storage device. The present invention has particularly beneficial effects with respect to the temperature distribution occurring in a substantially parallel direction to the main scanning direction.

Preferably, the heating drive signal includes a common heating drive signal which contains a plurality of types of heating waveform components corresponding to different amounts of heat generated by the heating elements; and the liquid ejection apparatus further comprises a heating drive selection device which selectively applies, from the heating element drive device to each of the heating elements which is to generate the amount of heat, at least one of the heating waveform components of the common heating drive signal corresponding to the amount of heat to be generated by each of the heating elements.

Since the common heating drive signal including at least one heating waveform component from the plurality of different types of heating waveform components is applied selectively to each of the heating elements, by the common heating element drive device, then it is possible to reduce the number of heating element drive devices compared to a mode where a heating element drive device is provided for each heating element.

A switching device having a plurality of switching elements, such as analog switches, or a switching IC having a control unit, or the like, which controls the on and off switching of the switching elements, on the basis of a control signal, are suitable for use as the heating drive selection device. A plurality of switching ICs of this kind may also be provided.

Preferably, the liquid ejection apparatus further comprises: an ejection element drive device which applies a common ejection drive signal including a plurality of types of ejection waveform components for ejecting ink droplets of a plurality of different volumes, to the ejection elements; and an ejection drive selection device which selectively applies at least one of the ejection waveform components of the common ejection drive signal, to the ejection elements which are to perform ejection, of the plurality of ejection elements, wherein at least a portion of the common ejection drive signal also serves as the common heating drive signal, and the ejection element drive device applies the common ejection drive signal serving as the common heating drive signal to the heating elements through the heating drive selection device.

By using at least a portion of the ejection element drive device also as the heating element drive device, and using the common heating drive waveform also as the common ejection drive waveform, it is possible to use ejection element driving and heating element driving, selectively, in accordance with the drive conditions of the ejection elements, and hence improved efficiency of use of the ejection element drive device can be expected. Moreover, in a mode where a plurality of ejection element drive devices are provided, desirably, the ejection drive selection device and the heating drive selection device are controlled in such a manner that the loads on the ejection element drive devices become equal to each other.

Preferably, the heating control device controls the heating drive selection device in such a manner that, if the number of the ejection elements to be driven by the ejection element drive device is less than a prescribed reference number of driven elements, a drive capacity corresponding to a differential between the prescribed reference number of driven elements and the number of the ejection elements to be driven by the ejection element drive device is applied to the heating elements from the ejection element drive device, as the common ejection drive signal.

Since surplus energy of the ejection element drive device can be utilized as drive energy for the heating elements, then there is no redundancy in the heating element drive device and therefore, the heating element drive device can be simplified, thus contributing toward size reduction.

Preferably, the ejection element drive device also serves as the heating drive device.

Since the ejection element drive device also serves as the heating element drive device, the heating element drive device becomes unnecessary and hence the composition of the apparatus can be simplified.

According to the present invention, in a liquid ejection head in which a plurality of ejection element groups are arranged in the main scanning direction, each of the ejection element groups having a plurality of ejection elements aligned in direction substantially parallel to the sub-scanning direction, the number of driven ejection elements in each of the ejection element groups is previously predicted, and the amount of heat to be generated by heating elements which are disposed so as to correspond to the respective ejection element groups is controlled on the basis of the number of driven ejection elements thus predicted. Therefore, it is possible to maintain a uniform temperature in the liquid ejection head, even if a temperature measurement device is not provided. Particularly beneficial effects are obtained in cases where a temperature distribution occurs in a direction aligned with the main scanning direction, in a liquid ejection head having a lengthwise direction which coincides with the main scanning direction.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
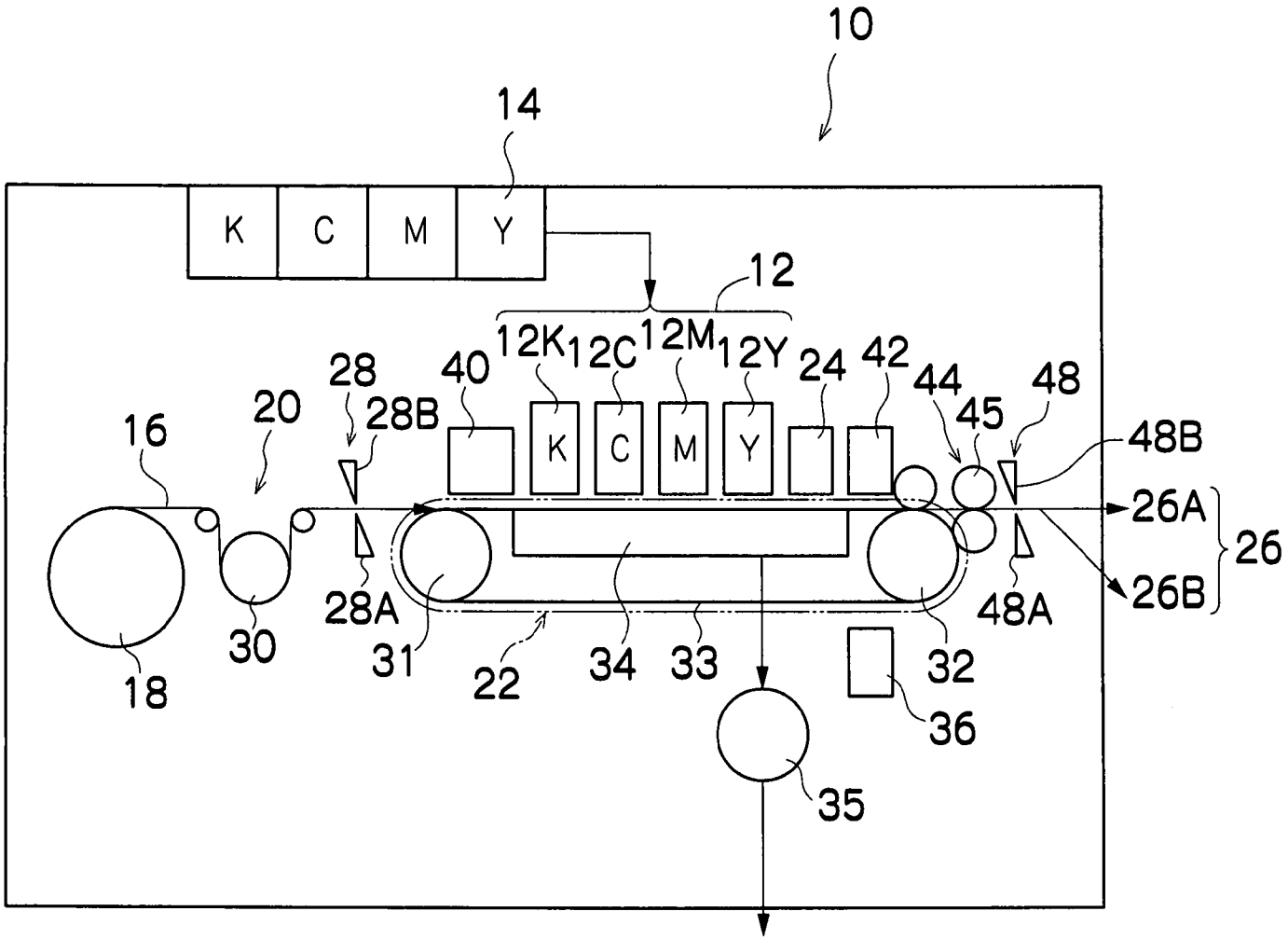
FIG. 1 is a general schematic drawing of an inkjet recording apparatus according to an embodiment of the present invention.

FIG. 1 is a general configuration diagram of an inkjet recording apparatus according to an embodiment of the present invention. As shown in FIG. 1, the inkjet recording apparatus 10 comprises: a printing unit 12 having a plurality of inkjet heads (liquid ejection heads, hereinafter also referred to as "print heads" or "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 which is an ejection receiving medium; a decurling unit 20 removing curl in the recording paper 16; a suction belt conveyance unit 22 (conveyance device) disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28.

The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
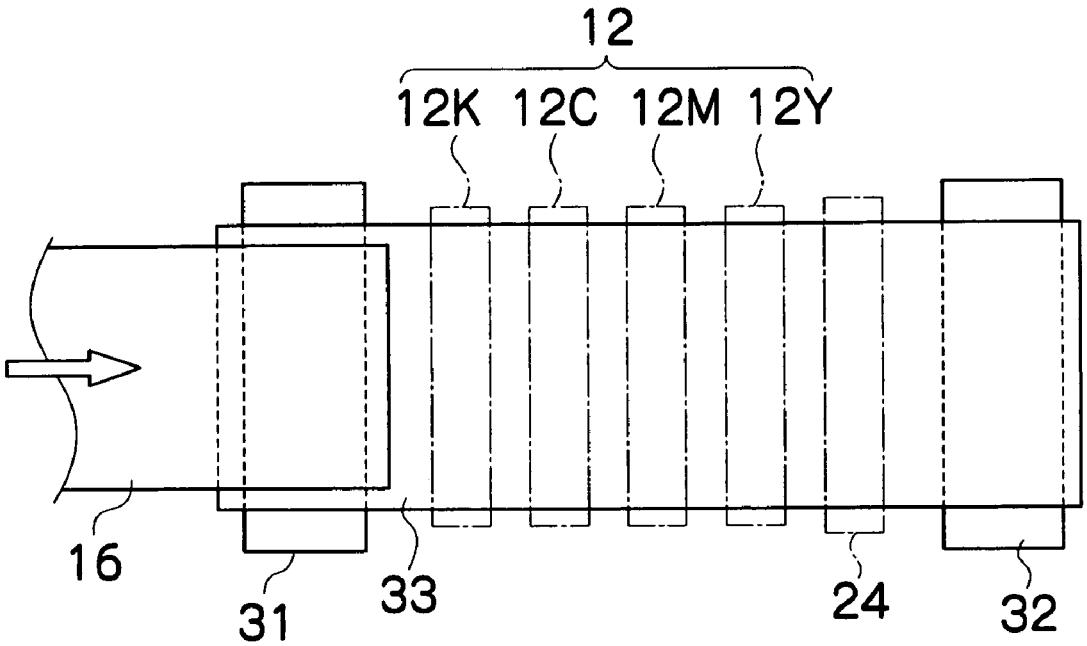
FIG. 2 is a principal plan diagram of the peripheral area of a print unit in the inkjet recording apparatus illustrated in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although a configuration with the four standard colors of K, C, M and Y is described in the present embodiment, combinations of the ink colors and the number of colors are not limited to those. Light and/or dark inks, and special color inks can be added as required. For example, a configuration is possible in which inkjet heads for ejecting light-colored inks such as light cyan and light magenta are added. Furthermore, there are no particular restrictions of the sequence in which the heads of respective colors are arranged. Moreover, in a two-liquid system which causes the ink coloring material to aggregate by making a treatment liquid react with the ink on the recording paper 16, a composition may be adopted in which a treatment liquid ejection head for ejecting the treatment liquid is appended, in addition to the heads for ejecting ink.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of the head is described. The heads 12K, 12C, 12M and 12Y of the respective ink colors have the same structure, and a reference numeral 50 is hereinafter designated to any of the heads.

Figure 3A:
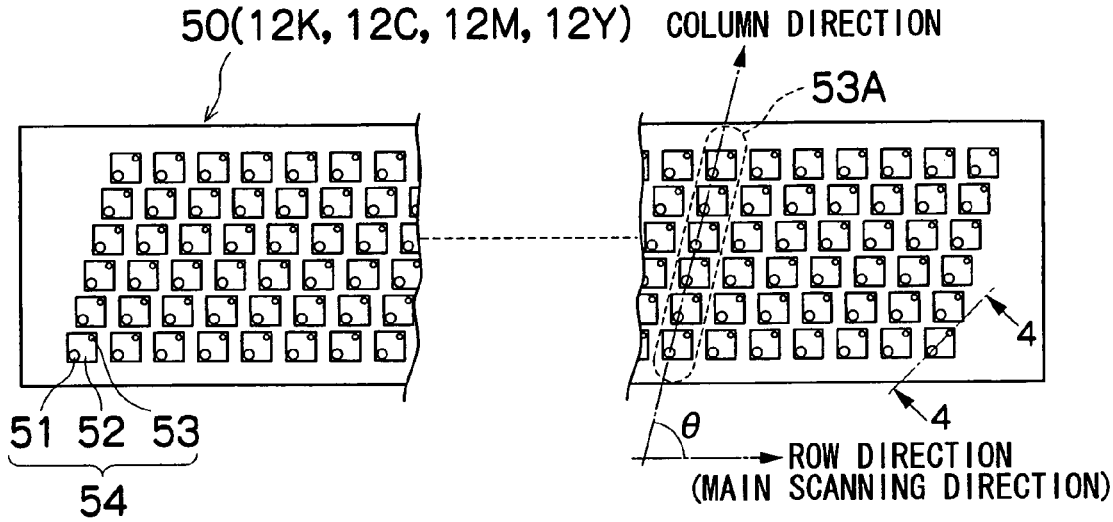
FIG. 3A is a plan view perspective diagram showing an embodiment of the composition of a print head.
Figure 3B:
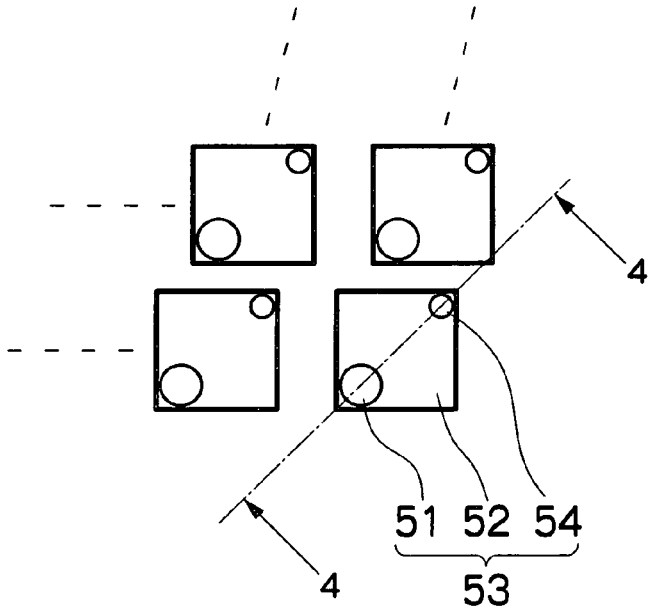
FIG. 3B is a principal enlarged view of FIG. 3A.
Figure 3C:
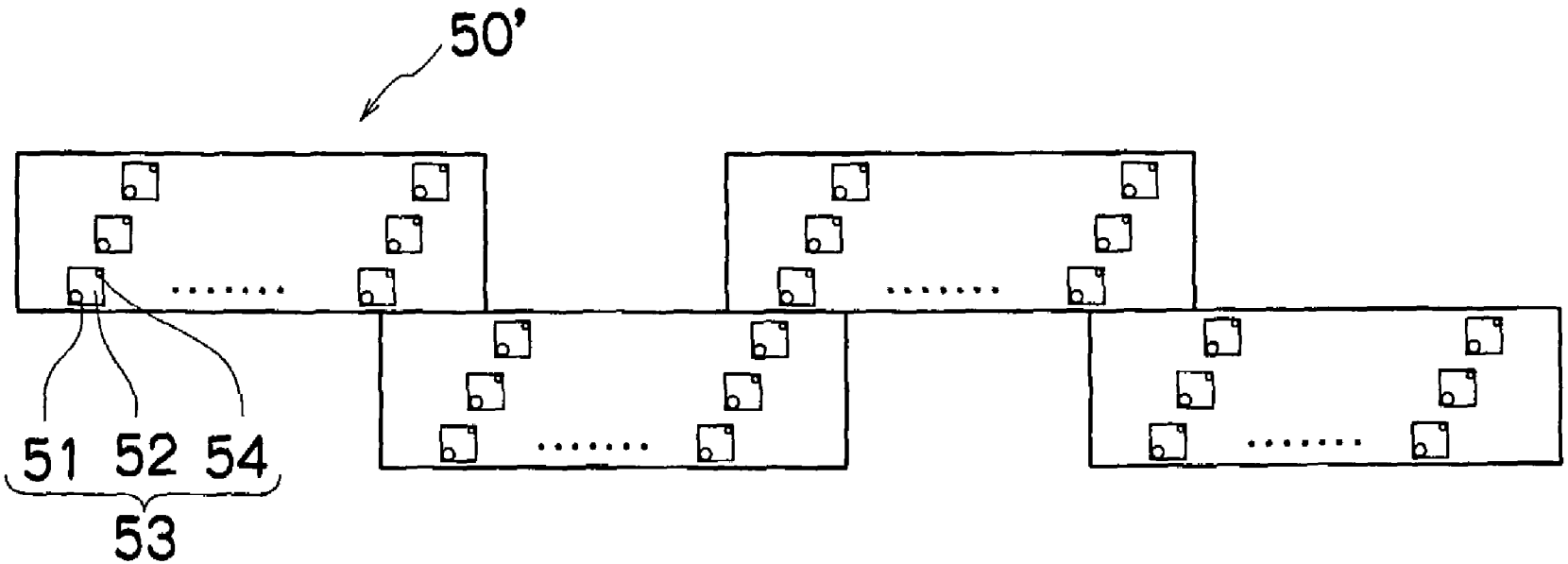
FIG. 3C is a plan view perspective diagram showing a further embodiment of the composition of a full line head.
Figure 4:
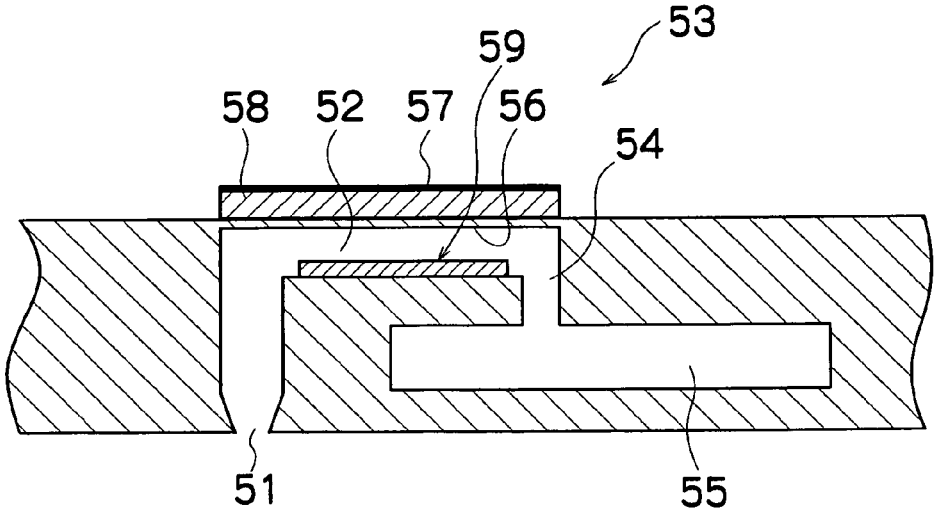
FIG. 4 is a cross-sectional view along line 4-4 in FIG. 3A.

FIG. 3A is a perspective plan view showing an embodiment of the configuration of the head 50 (liquid ejection head), FIG. 3B is an enlarged view of a portion thereof, FIG. 3C is a perspective plan view showing another embodiment of the configuration of the head 50, and FIG. 4 is a cross-sectional view taken along the line 4-4 in FIGS. 3A and 3B, showing the inner structure of an ejection element (an ink chamber unit for one nozzle 51).

The nozzle pitch in the head 50 should be minimized in order to maximize the resolution of the dots printed on the surface of the recording paper 16. As shown in FIGS. 3A and 3B, the head 50 according to the present embodiment has a structure in which a plurality of ejection elements (ink chamber units) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

In other words, the high-density nozzle head according to the present embodiment is achieved by composing the plurality of ejection elements in a lattice arrangement, based on a fixed arrangement pattern having a row direction which coincides with the direction substantially perpendicular to the conveyance direction of the recording paper 16 (main scanning direction), and a column direction which is inclined at a fixed angle of θ with respect to the main scanning direction, rather than being perpendicular to same. In other words, the head 50 according to the present embodiment has a structure in which a plurality of ejection element groups 53A, each comprising a plurality of ejection elements arranged in the column direction, are arranged in the main scanning direction. In the mode shown in FIG. 3B, one ejection element group 53A has six ejection elements 53.

The mode of forming one or more nozzle rows through a length corresponding to the entire width of the recording paper 16 in a direction substantially perpendicular to the conveyance direction of the recording paper 16 is not limited to the embodiment described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

As shown in FIGS. 3A and 3B, the planar shape of the pressure chamber 52 provided for each nozzle 51 is substantially a square, and an outlet to the nozzle 51 and an inlet of supplied ink (supply port) 54 are disposed in both corners on a diagonal line of the square.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

A piezoelectric element (actuator) 58 provided with an individual electrode 57 is bonded to a pressure plate 56 (a diaphragm that also serves as a common electrode) which forms the ceiling of the pressure chambers 52. When a drive voltage is applied to the individual electrode 57, the piezoelectric element 58 is deformed, thereby changing the volume of the pressure chamber 52, and ink is ejected from the nozzle 51 as a result of the pressure change in the pressure chamber 52. After ejection of the ink, new ink is supplied to the pressure chamber 52 from the common liquid channel 55, via the supply port 54.

Figure 5:
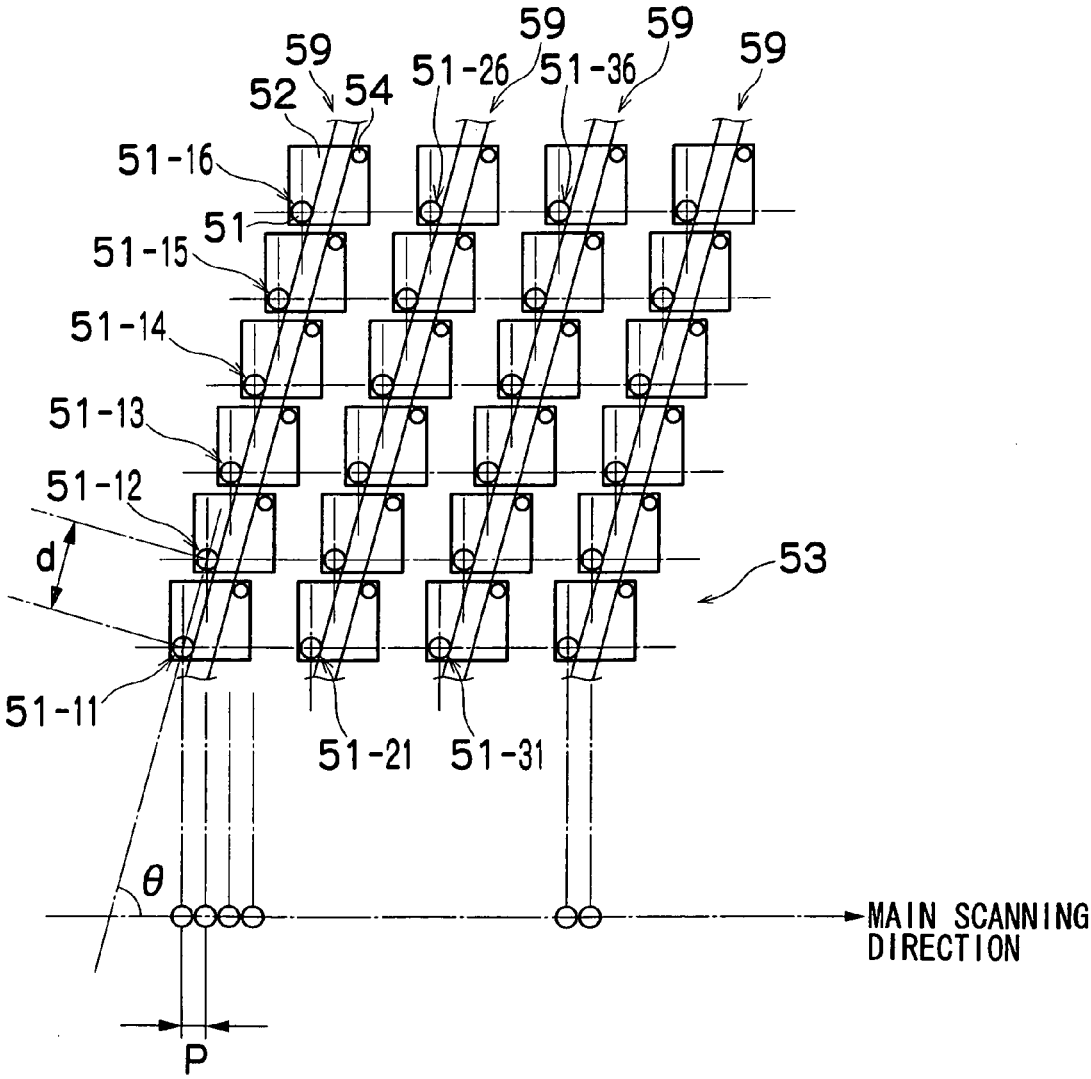
FIG. 5 is an enlarged view showing a nozzle arrangement in the print head illustrated in FIG. 3A.

Furthermore, as shown in FIG. 4, a heater 59 (heating element) for heating the ink inside the pressure chamber 52 is arranged in the pressure chamber 52. As shown in FIG. 5, each of the heaters 59 is provided so as to correspond to each of the ejection element groups 53A arranged in the column direction as shown in FIG. 3B. More specifically, the heaters 59 each have substantially the same length as the length of the ejection element groups 53A in the column direction, and the heaters 59 are disposed in the row direction shown in FIG. 3B. FIG. 5 shows the heaters 59 of four columns arranged in the row direction, but the head 50 is provided with the same number of heaters 59 as the number of ejection element groups 53A arranged in the row direction.

The present embodiment describes a mode in which the heaters 59 are arranged inside the pressure chambers 52, but the positioning of the heaters 59 is not limited to being inside the pressure chambers 52, and they may also be positioned on the outside of the walls that form the pressure chambers 52, in the nozzles 51 or vicinity of the nozzles 51, in the vicinity of the supply ports 54, in the supply side flow path, such as the common liquid chamber 55, or the like. In a structure laminated from a plurality of cavity plates as shown in FIG. 4, the heaters 59 may be formed as a cavity plate which constitutes the laminated structure. In a mode in which the heaters 59 are formed as one layer of the laminated structure in this way, printed resistances can be used for the heaters 59. If the heaters 59 are formed on a surface which makes contact with the ink, then prescribed surface treatment, such as insulation treatment, liquid resistance treatment, or the like, is carried out.

A resistor body is suitable for use as the heater 59. When a prescribed drive signal (drive voltage) is applied to the heater 59 (when a prescribed drive current is passed through same), the heater 59 generates heat corresponding to the applied drive voltage, and the ink inside the pressure chamber 52 is heated up by this heat. On the other hand, if the voltage application to the heater 59 is halted, then with the passage of time, the temperature of the ink inside the pressure chamber 52 gradually declines. In other words, by controlling and varying the voltage applied to the heater 59, it is possible to vary the temperature of the ink inside the pressure chamber 52. The details of the control of the heater 59 are described later.

As shown in FIG. 5, by adopting a structure in which the plurality of ejection elements 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a regular pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. Incidentally, when implementing the present invention, the arrangement structure of the nozzles is not limited to the embodiment shown in the drawings.

Configuration of Ink Supply System

Figure 6:
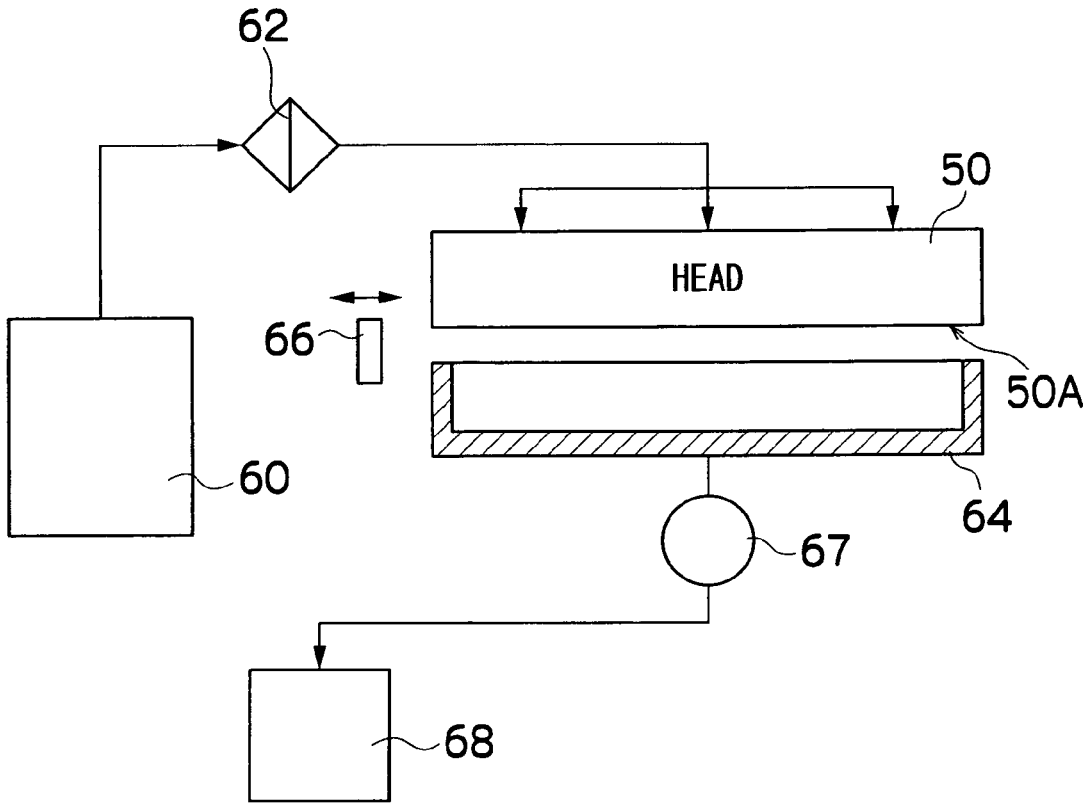
FIG. 6 is a schematic drawing showing the composition of an ink supply system in the inkjet recording apparatus.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the piezoelectric elements 58 for the ejection driving are operated. Before reaching such a state (in a viscosity range that allows ejection by the operation of the piezoelectric elements 58) the piezoelectric elements 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the piezoelectric elements 58 is operated. Also, when the ink viscosity inside the nozzle 51 has increased over a certain level, ink can no longer be ejected from the nozzle 51 even if the piezoelectric elements 58 are operated. In these cases, a suctioning device to remove the ink inside the pressure chamber 52 by suction with a suction pump, or the like, is placed on the nozzle face 50A of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
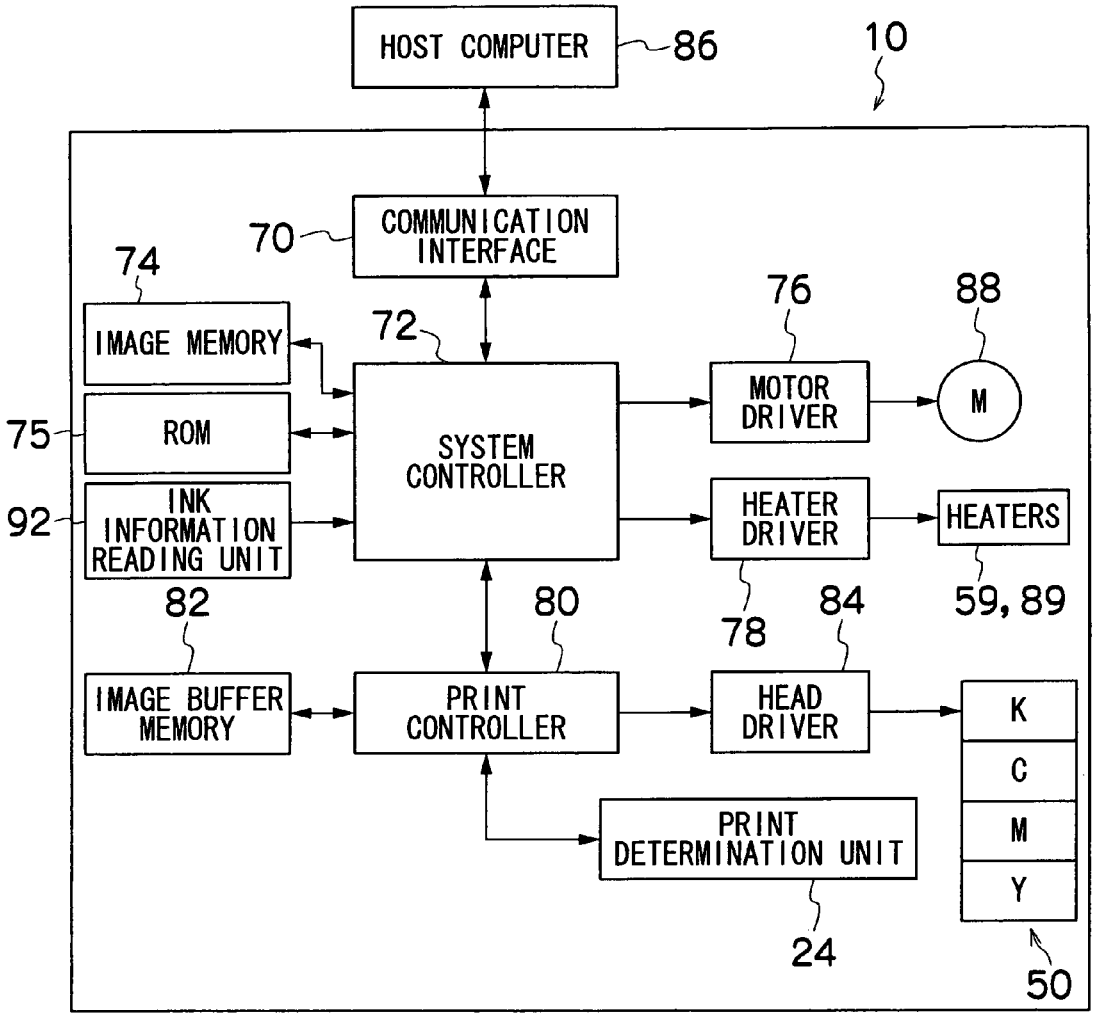
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data and control parameters which are required for control procedures are stored in the ROM 75. The ROM 75 may be a non-writeable storage elements (storage device), or it may be a rewriteable storage elements, such as an EEPROM. The image memory 74 is used as a temporary storage region for the image data, and it is also used as a program development region and a calculation work region for the CPU.

The motor driver 76 is a driver which drives the motor 88 in accordance with instructions from the system controller 72. The heater driver 78 (heating element control device) is a driver which drives the heaters 59 shown in FIG. 5, and the heater 89 of the post-drying unit 42, in accordance with instructions from the system controller 72. The motor 88 includes a plurality of motors, such as a motor for driving the rollers 31 and 32 of the belt suction conveyance unit 22, and the heater 89 includes a plurality of heaters such as a heater provided in the post-drying unit 42.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

Furthermore, the print controller 80 predicts the number of ejection elements to be driven in each of the ejection element groups 53A shown in FIG. 3B, on the basis of the dot data. The print controller 80 then sends a control signal to the heater driver 78 in accordance with the number of driven ejection elements in each ejection element group 53A, and the heater driver 78 controls the heaters 59 on the basis of this control signal.

The head driver 84 drives the piezoelectric elements 58 of the heads of the respective colors 12K, 12C, 12M and 12Y on the basis of dot data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color by means of the well-known method such as dithering method or error diffusion method, in the print controller 80. In other words, the print controller 80 performs processing for converting the inputted RGB image data into dot data for four colors, K, C, M and Y. The dot data generated by the print controller 80 is stored in the image buffer memory 82.

The head driver 84 outputs signals for driving the piezoelectric elements 58 of the head 50, on the basis of the dot data stored in the image buffer memory 82, and ink is ejected from the head 50 by applying the drive signals output by the head driver 84 to the head 50. By controlling ink ejection from the print heads 50 in synchronization with the conveyance speed of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

Furthermore, the inkjet recording apparatus 10 according to the present embodiment comprises an ink information reading unit 92. The ink information reading unit 92 is a device for reading in information relating to the ink type. More specifically, it is possible to use, for example, a device which reads in ink properties information from the shape of the cartridge in the ink tank 60 (a specific shape which allows the ink type to be identified), or from a bar code or IC chip incorporated into the cartridge. Besides this, it is also possible for an operator to input the required information by means of a user interface.

Description of Head Driving Method

Figure 8:
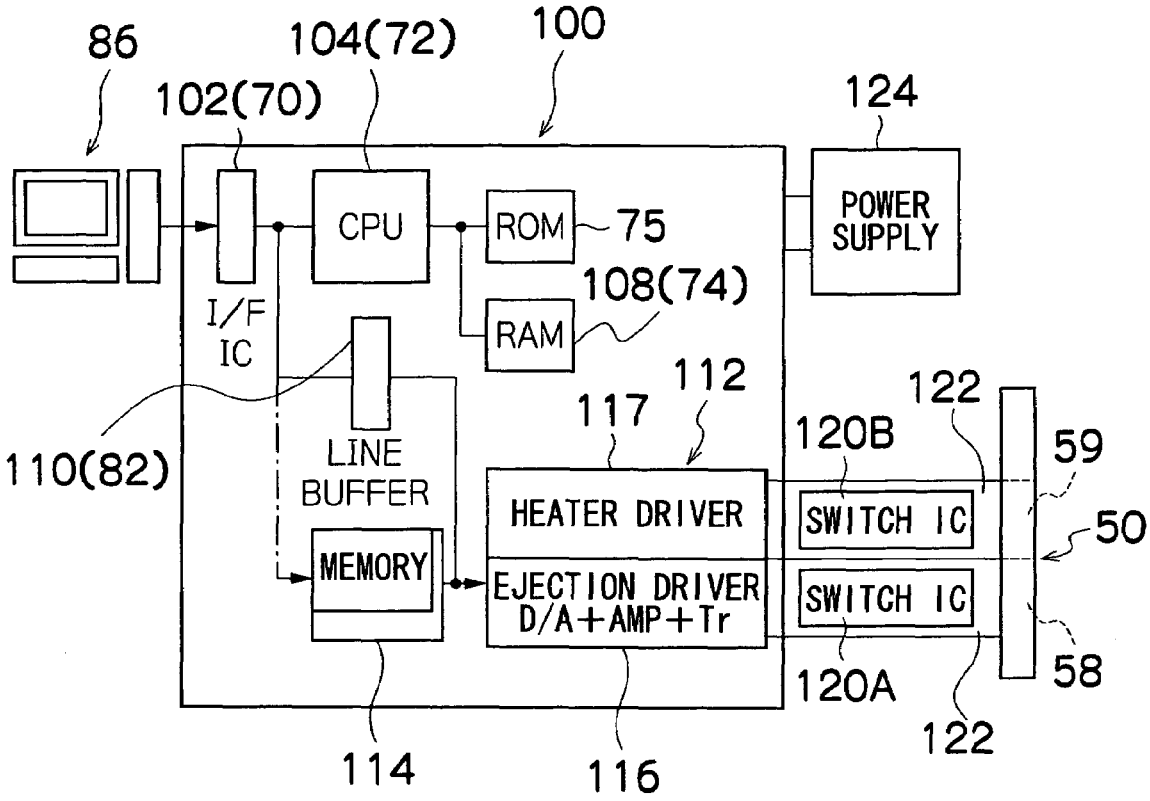
FIG. 8 is a principal schematic drawing of the main circuit relating to head driving of the inkjet recording apparatus.

Next, the method of driving the head 50 in the inkjet recording apparatus 10 according to the present embodiment (the method of driving the piezoelectric elements 58 and the method of driving the heaters 59) is described. FIG. 8 is a principal compositional diagram of the main circuit relating to the head driving of the inkjet recording apparatus 10.

A communication interface IC 102, CPU 104, ROM 75, RAM 108, line buffer 110 and head controller 112 are installed on a circuit board 100 mounted on an inkjet recording apparatus 10.

The communications interface IC 102 corresponds to the communications interface indicated by reference numeral 70 in FIG. 7. The CPU 104 in FIG. 8 functions as the system controller 72 shown in FIG. 7. The RAM 108 in FIG. 8 functions as the image memory 74 shown in FIG. 7, and the line buffer 110 in FIG. 8 functions as the image buffer memory 82 shown in FIG. 7. It is also possible to provide a memory 114, instead of or in conjunction with the line buffer 110. The memory 114 can also share a portion of the RAM 108.

The head controller 112 shown in FIG. 8 comprises: an ejection drive unit 116 (ejection element drive device) corresponding to the head driver 84 shown in FIG. 7 which is constituted by a D/A converter 126 (shown in FIG. 9), an amplifier 127 (shown in FIG. 9), and a drive circuit 130 (shown in FIG. 9) such as a push-pull circuit 129 including transistors or the like (shown in FIG. 9); and a heater drive unit 117 (heating element drive device) which corresponds to the heater driver 78 shown in FIG. 7 and which drives the heaters 59 shown in FIG. 5.

The ejection drive unit 116 and the heater drive unit 117 of the head controller 112 shown in FIG. 8 are electrically connected respectively to the piezoelectric elements 58 (not shown in FIG. 8, but shown in FIG. 5), and the heaters 59 (not shown in FIG. 8, but shown in FIG. 5) of the head 50, via wiring members 122 (for example, wiring members each composed of a flexible printed circuit and a rigid printed circuit) mounted with a switching IC 120A (ejection drive selection device) and a switching IC 120B (heating drive selection device).

Figure 11:
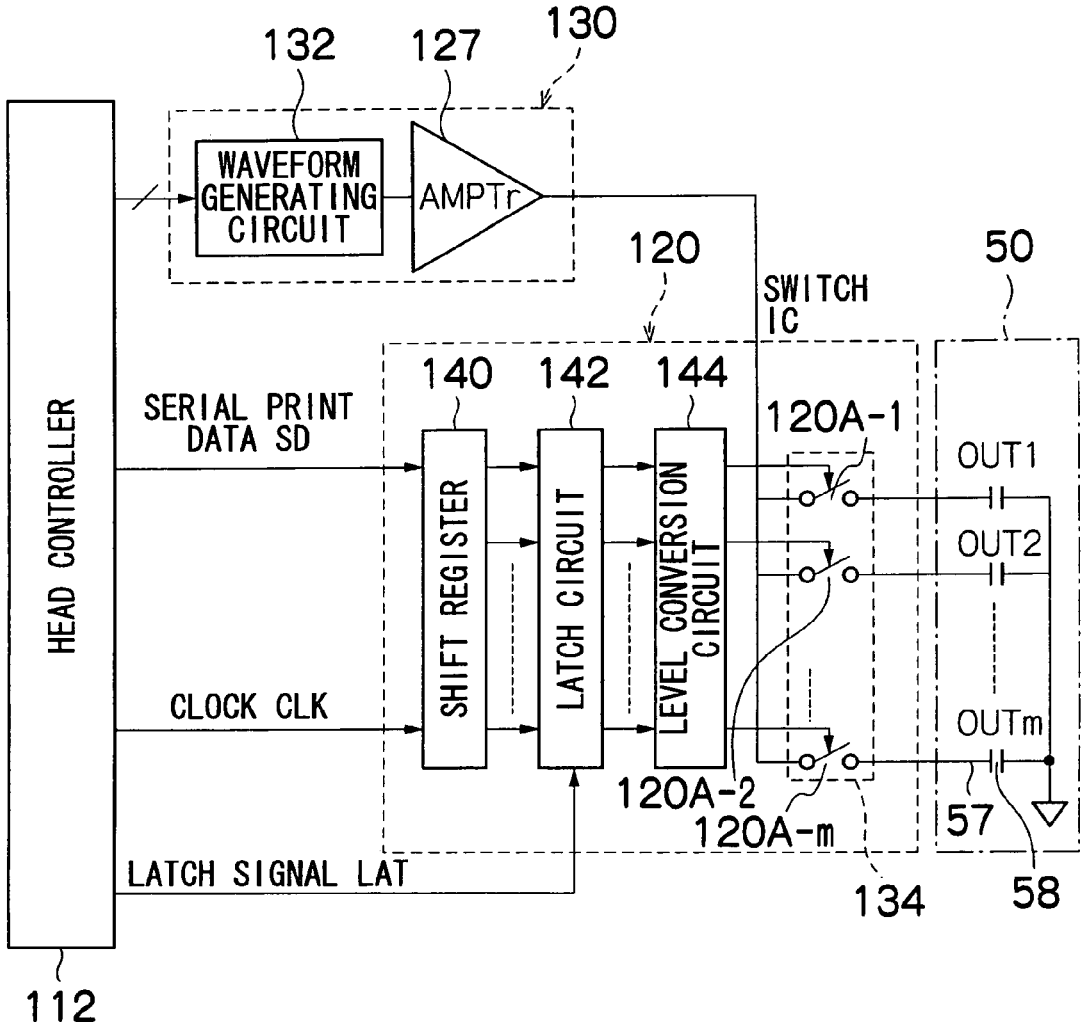
FIG. 11 is a block diagram showing the detailed composition of the main circuit relating to the head driving shown in FIG. 8.

The switching ICs 120A and 120B are constituted by a serial/parallel (S/P) conversion circuit and a switching array 134 (shown in FIG. 11). It is possible that a single device serves as both the switching ICs 120A and 120B. The power supply circuit 124 is connected to the circuit board 100, in such a manner that electrical power is supplied to the respective circuit blocks from the power supply circuit 124.

Figure 9:
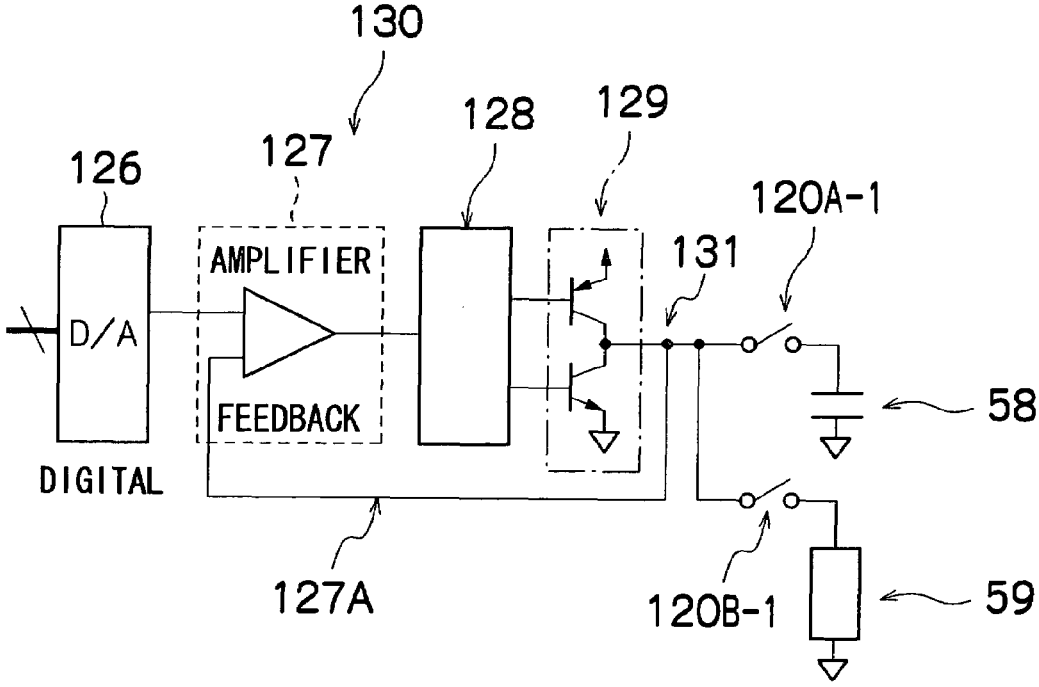
FIG. 9 is a schematic drawing of the ejection element and heater drive circuits, of the main circuit relating to the head driving shown in FIG. 8.

FIG. 9 shows the detailed composition of a drive circuit 130 included in the ejection drive unit 116 and heater drive unit 117. The drive circuit contained in the ejection drive unit 116 and the drive circuit contained in the heater drive unit 117 have a common basic structure. In the composition shown in FIG. 9, it is possible to drive any of the piezoelectric elements 58 or heaters 59, by time division, by applying a drive signal outputted from the drive circuit 130 (a drive signal which serves as a drive signal applied to the piezoelectric elements 58 and a drive signal applied to the heaters 59).

If the piezoelectric elements 58 and the heaters 59 are driven by the single drive circuit 130, then the output part 131 of the drive circuit 130 is connected to the piezoelectric elements 58 via switching elements 120A-1, as well as being connected to the heaters 59 via a switching element 120B-1. By controlling and switching the switching elements 120A-1 and the switching elements 120B-1, it is possible to apply a prescribed drive signal to any of the piezoelectric elements 58 or the heaters 59.

As shown in FIG. 9, the drive circuit 130 is constituted by the D/A converter 126, the amplifier circuit 127 including a feedback circuit (feedback loop) 127A, a charging and discharging circuit 128, the push-pull circuit 129 including the transistors, and the like. The drive signal (drive voltage) outputted by the output part 131 is supplied respectively to the piezoelectric elements 58 and the heaters 59, via the switching elements 120A-1 contained in the switching IC 120A shown in FIG. 8 and the switching elements 120B-1 contained in the switching IC 120B shown in FIG. 8.

Figure 10:
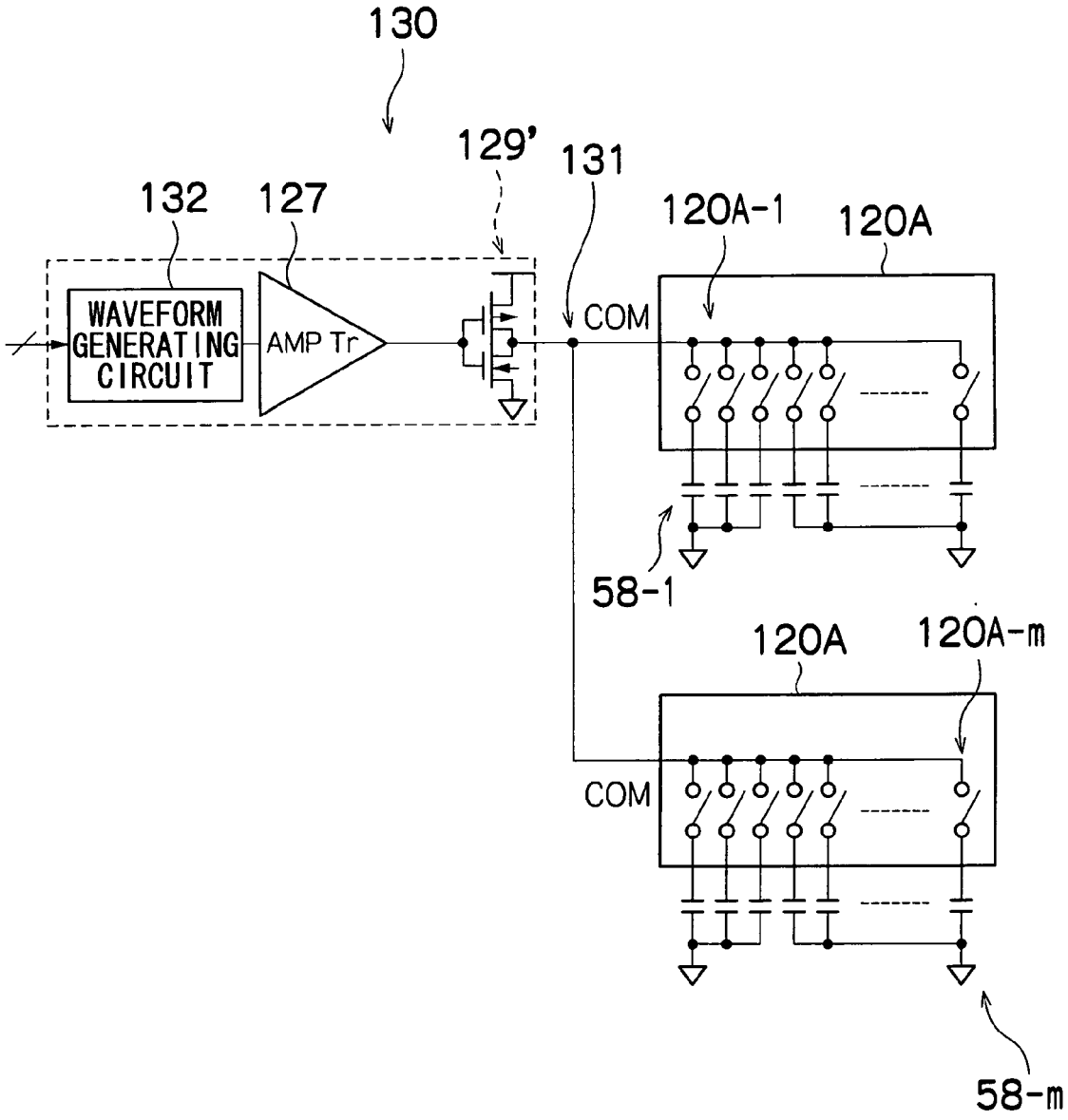
FIG. 10 is a diagram showing a switching IC.

FIG. 10 shows a basic composition in which a drive signal is applied selectively to a plurality (m) of piezoelectric elements 58-1 to 58-*m*, from the drive circuit 130 (a common drive circuit which supplies drive signals to the plurality of piezoelectric elements 58).

The drive circuit 130 shown in FIG. 10 comprises a waveform generating circuit 132 including the D/A converter 126 (shown in FIG. 9) which converts the digital waveform data outputted by the head controller 112 shown in FIG. 8 into analog signals, the amplifier 127 which amplifies the drive waveform in accordance with the output level of the waveform generating circuit 132, and a push-pull circuit 129'. In other words, the digital waveform data of the drive waveform outputted from the head controller 112 is inputted to the waveform generating circuit 132, and converted into the analog signal corresponding to the input waveform data, in the waveform generating circuit 132. This analog waveform signal is amplified to a prescribed level by the amplifier circuit 127, the power of the signal is amplified by the push-pull circuit 129', and the signal is then outputted as the drive signal.

FIG. 9 shows a mode where the bipolar transistors are used in the push-pull circuit 129, but it is also possible to adopt a composition in which field-effect transistors (FET) are used instead of the bipolar transistors, as in the push-pull circuit 129' shown in FIG. 10. In the drive circuit 130 shown in FIG. 10, the waveform generating circuit 132 contains the D/A converter 126 shown in FIG. 9, but does not include the charging and discharging circuit 128 shown in FIG. 9.

The drive signal outputted from the output part 131 of the drive circuit 130 is inputted to COM ports of the switching ICs 120A, and by selectively switching the switching elements 120A-1 to 120A-m, the signal is supplied selectively to the piezoelectric elements 58-1 to 58-*m*. In the present embodiment, the composition shown in FIG. 10 may also be used for a composition for selectively supplying a drive signal to a plurality (n) of heaters 59-1 to 59-*n*.

Here, the composition of the switching ICs 120 is described in detail with reference to FIG. 11. As shown in FIG. 11, the head controller 112 generates print data developed into a dot pattern, on the basis of the image information supplied from the host computer 86 (see FIG. 8), and it also generates a latch signal (LAT) for controlling the serial transmission clock signal (CLK) and the latch timing. The print data generated by the head controller 112 are sent (by serial transmission) as print serial data SD with the clock signal CLK to the shift register 140, in synchronism with the clock signal CLK. The print data stored in the shift register 140 is latched by the latch circuit 142 on the basis of the latch signal LAT outputted from the head controller 112.

The signal latched by the latch circuit 142 is converted in the level conversion circuit 144 to a prescribed voltage value which is capable of driving the switching elements 120A-1 to 120A-m. The switching elements 120A-1 to 120A-m are switched on and off by the output signal of the level conversion circuit 144.

Figure 12A:
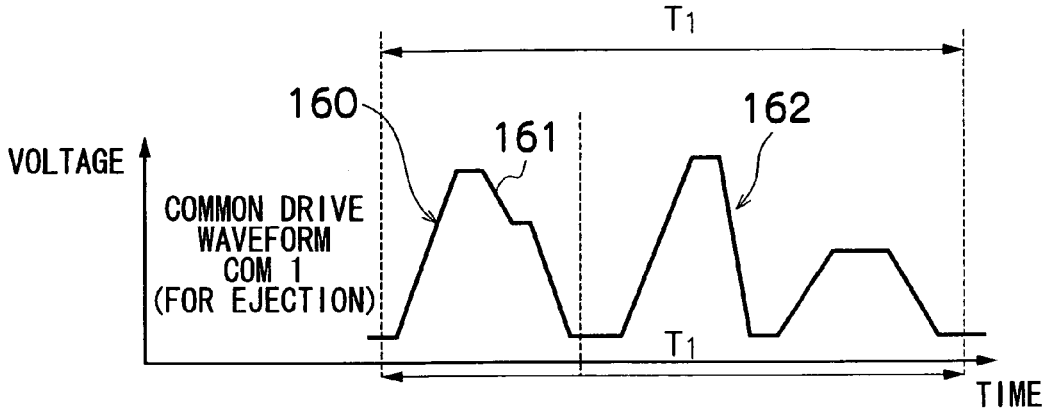
FIGS. 12A to 12D are waveform diagrams showing embodiments of drive waveforms.

FIG. 12A is a waveform diagram showing one embodiment of a common drive waveform for ejection. As shown in FIG. 12A, this common ejection drive waveform 160 comprises a first waveform component 161 for ejecting a liquid droplet to form a small dot (for example, 3 pl), and a second waveform component 162 for ejecting a liquid droplet to form a medium dot (for example, 6 pl), the first and second waveform components being joined in a continuous fashion. A waveform combining the first waveform component 161 and the second waveform component 162 is repeated at a period of T1.

By applying the first waveform component 161 of the common ejection drive waveform 160, to a piezoelectric element, a liquid droplet forming a small dot is ejected, and by applying only the second waveform component 162, a liquid droplet forming a medium dot is ejected. Furthermore, by applying both the first waveform component 161 and the second waveform component 162 to the piezoelectric element in a continuous fashion, a liquid droplet forming a large dot (for example, 9 pl) is ejected.

The application timing of the drive waveform (ejection timing) varies within the ejection cycle Ti, in accordance with the volume of the liquid droplet to be ejected, but the difference in landing positions between a small dot and a medium dot due to this time difference comes within a range which can be regarded as substantially the same image pixel on the recording medium.

By controlling the switching IC 120 shown in FIG. 10 and FIG. 11, it is possible selectively to apply the first waveform component 161 and/or the second waveform component 162 shown in FIG. 12A, to the piezoelectric elements 58 of the ejection elements 53.

Figure 12B:
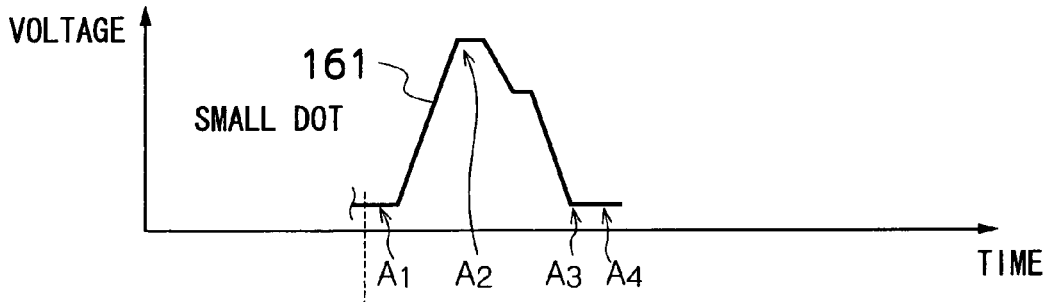
Figure 12C:
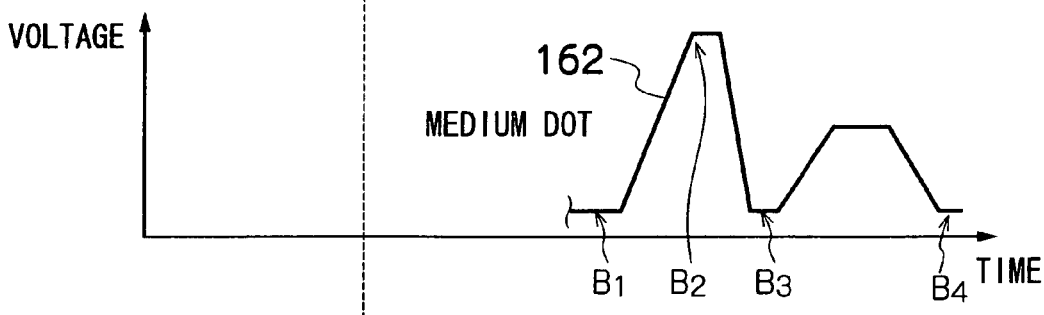
Figure 12D:
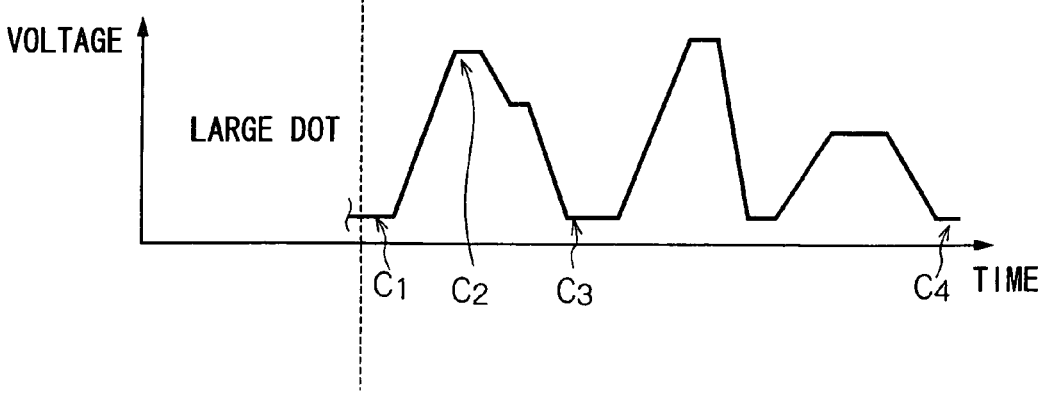

FIG. 12B shows a waveform that is applied to the piezoelectric element 58 when ejecting a small dot, FIG. 12C shows a waveform applied to the piezoelectric element 58 when ejecting a medium dot, and FIG. 12D shows a waveform applied to the piezoelectric element 58 when ejecting a large dot.

In the waveform diagrams shown in FIGS. 12B, 12C and 12D, if the characters "A" "B" and "C" are represented by "n" (where n=A, B, C) in the sections A1 to A4, B1 to B4, and C1 to C4, then "n1" corresponds to stabilizing the meniscus, "n2" corresponds to pulling the meniscus, "n3" corresponds to pushing the meniscus (in other words, ejection), and "n4" corresponds to a state of preparation for the next ejection.

The nozzles which are to perform ejection (in other words, the ejection elements to be driven), and the nozzles which are not to perform ejection (the ejection elements which are not to be driven), are determined on the basis of the print data, and one of the ejection waveforms shown in FIGS. 12B, 12C and 12D is applied to each of the ejection elements that are to be driven. It is also possible to adopt a composition in which a drive waveform for causing slight vibration of the meniscus (not shown) is applied to all or a portion of the ejection elements that are not to be driven. This drive waveform for creating slight vibration of the meniscus is a waveform which causes the meniscus to vibrate while restricting the energy to a level which does not cause ink to be ejected from the nozzle 51. Compared to the common ejection drive waveform 160 shown in FIG. 12A, the drive waveform for creating slight vibration of the meniscus comprises very small vibration waveform components of small amplitude which are repeated at a prescribed cycle. To give one embodiment of this prescribed cycle, a mode is possible in which the cycle of the drive waveform for slight vibration of the meniscus is ⅓ of the cycle of the common ejection drive waveform 160. Of course, the relationship between the cycle of the drive waveform for slight vibration of the meniscus and the cycle of the common ejection drive waveform is not limited to this embodiment. In control terms, it is desirable for the cycle of the slight vibration waveform component in the drive waveform for causing slight vibration of the meniscus to be 1/N (where N is a positive integer) of the cycle of the common ejection drive waveform 160, since this makes it easier to control the application timing of the drive waveform for slight vibration of the meniscus.

Modification of Heater Arrangement

Next, an embodiment of the arrangement of the heaters 59 is described in detail with reference to FIG. 13A to FIG. 15. In order to simplify the drawings hereinafter, the ejection elements 53 are taken to be arranged in a substantially parallel direction with respect to the paper feed direction (sub-scanning direction) (in other words, the angle θ shown in FIG. 3A is taken to be 0°).

Figure 13A:
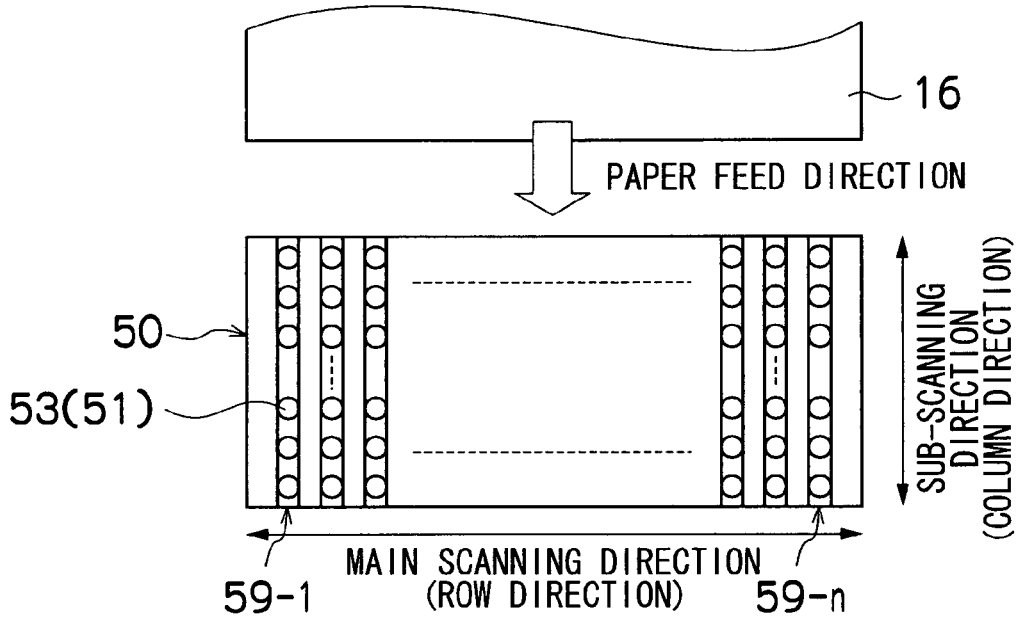
FIGS. 13A and 13B are diagrams showing modifications of the heater arrangement.
Figure 13B:
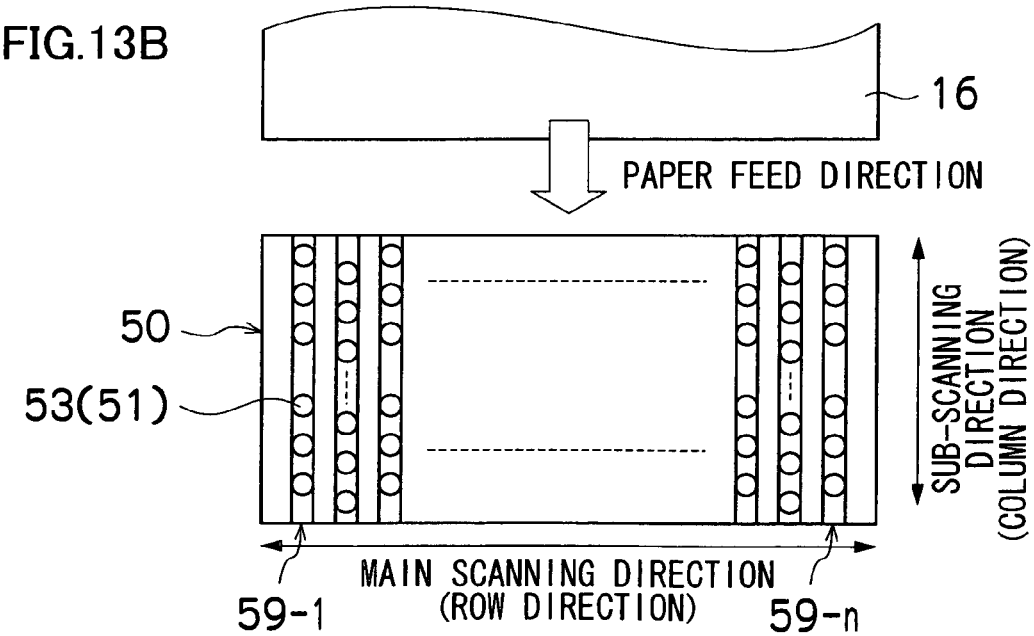

FIG. 13A shows an embodiment of the positioning of a plurality (n) of heaters 59 (59-1 to 59-*n*) arranged in the main scanning direction, the lengthwise direction of the heaters 59 being aligned with the column direction which coincides with the sub-scanning direction. Furthermore, as shown in FIG. 13B, the ejection elements 53 may also be arranged in a staggered matrix fashion with respect to the sub-scanning direction (namely, at a mutually staggered phase in the sub-scanning direction).

Figure 14:
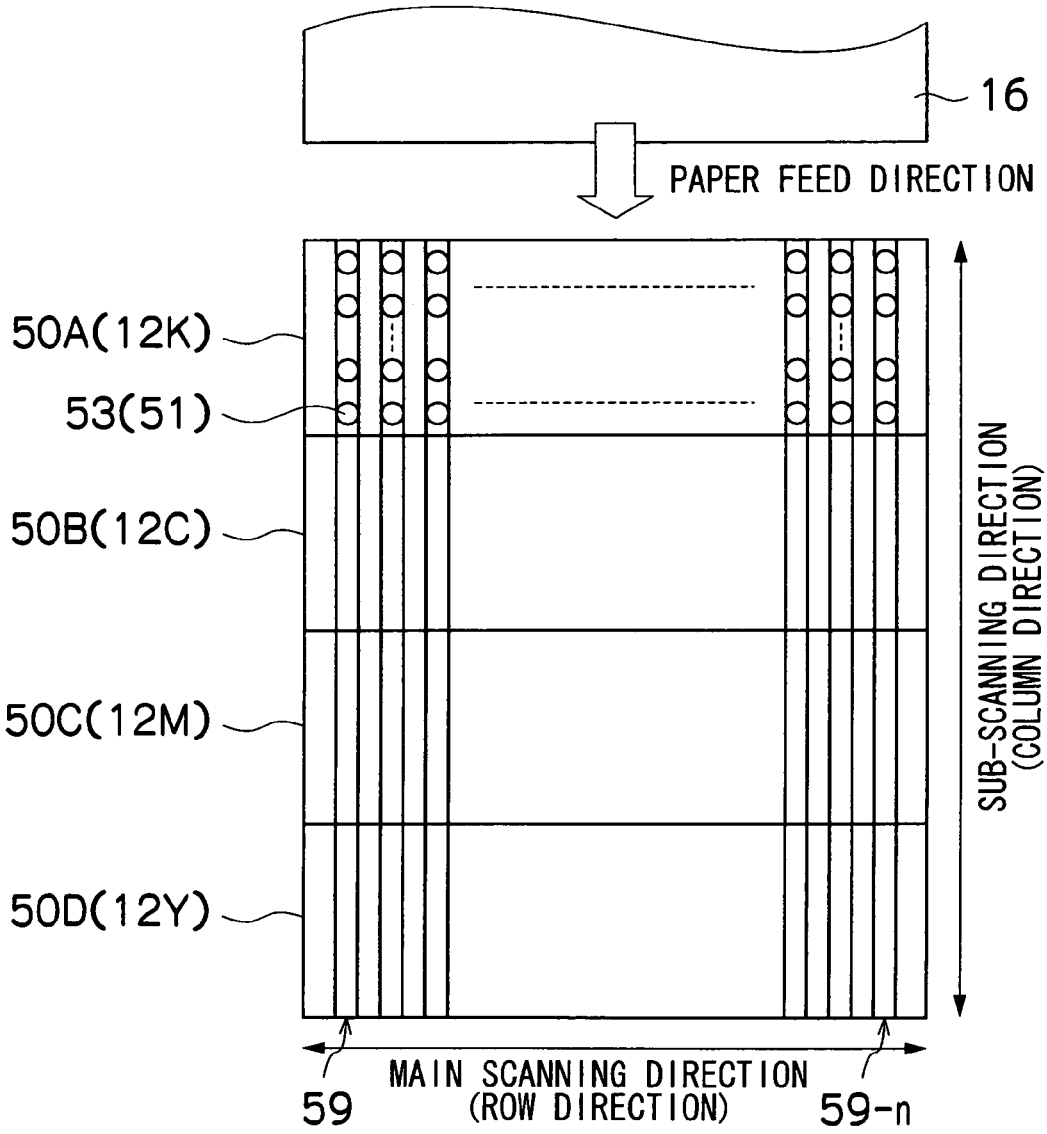
FIG. 14 is a diagram showing a further mode of the modification of the heater arrangement shown in FIGS. 13A and 13B.
Figure 15:
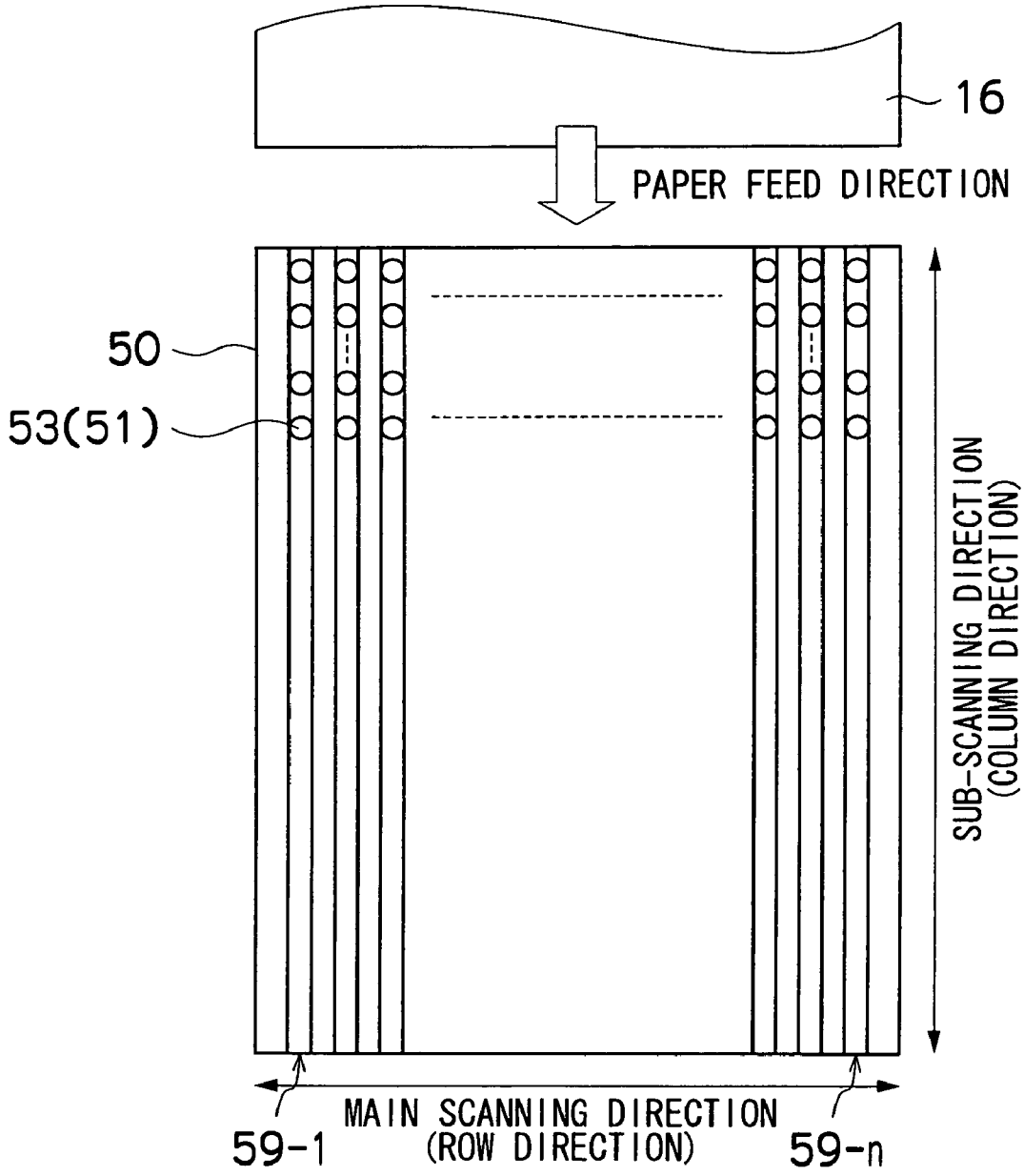
FIG. 15 is a diagram showing yet a further mode of the modification of the heater arrangement shown in FIGS. 13A and 13B.

Furthermore, as shown in FIG. 14, it is also possible to provide common heaters 59 for the plurality of heads 50A to 50D (for example, the print heads 12K, 12C, 12M and 12Y in FIG. 1). More specifically, in a mode where a plurality of heads 50A to 50D are provided, the heaters 59 are formed so as to pass through the heads 50A to 50D. Furthermore, as shown in FIG. 15, it is also possible to compose the four heads 50A to 50D shown in FIG. 14 in an integrated fashion.

Heater Drive Control:

First Embodiment

Next, the control of driving of the heaters 59 according to a first embodiment of the present invention is described. In the drive control of the heaters 59 shown in this embodiment, the number of nozzles 51 (ejection elements 53) to be driven is predicted (calculated) on the basis of the image data, for each of the ejection element groups 53A formed by the plurality of ejection elements 53 arranged in the sub-scanning direction which coincides with the paper feed direction, and control is implemented in such a manner that the amount of heat generated by each heater 59 corresponding to each ejection element group 53A is varied on the basis of the predicted number of driven ejection elements for each ejection element group 53A. It is also possible to adopt a composition in which driving of the heaters 59 is controlled on the basis of the driving rate (operating rate) of each of the ejection element groups 53A, rather than the number of driven ejection elements in each ejection element group 53A.

Figure 16:
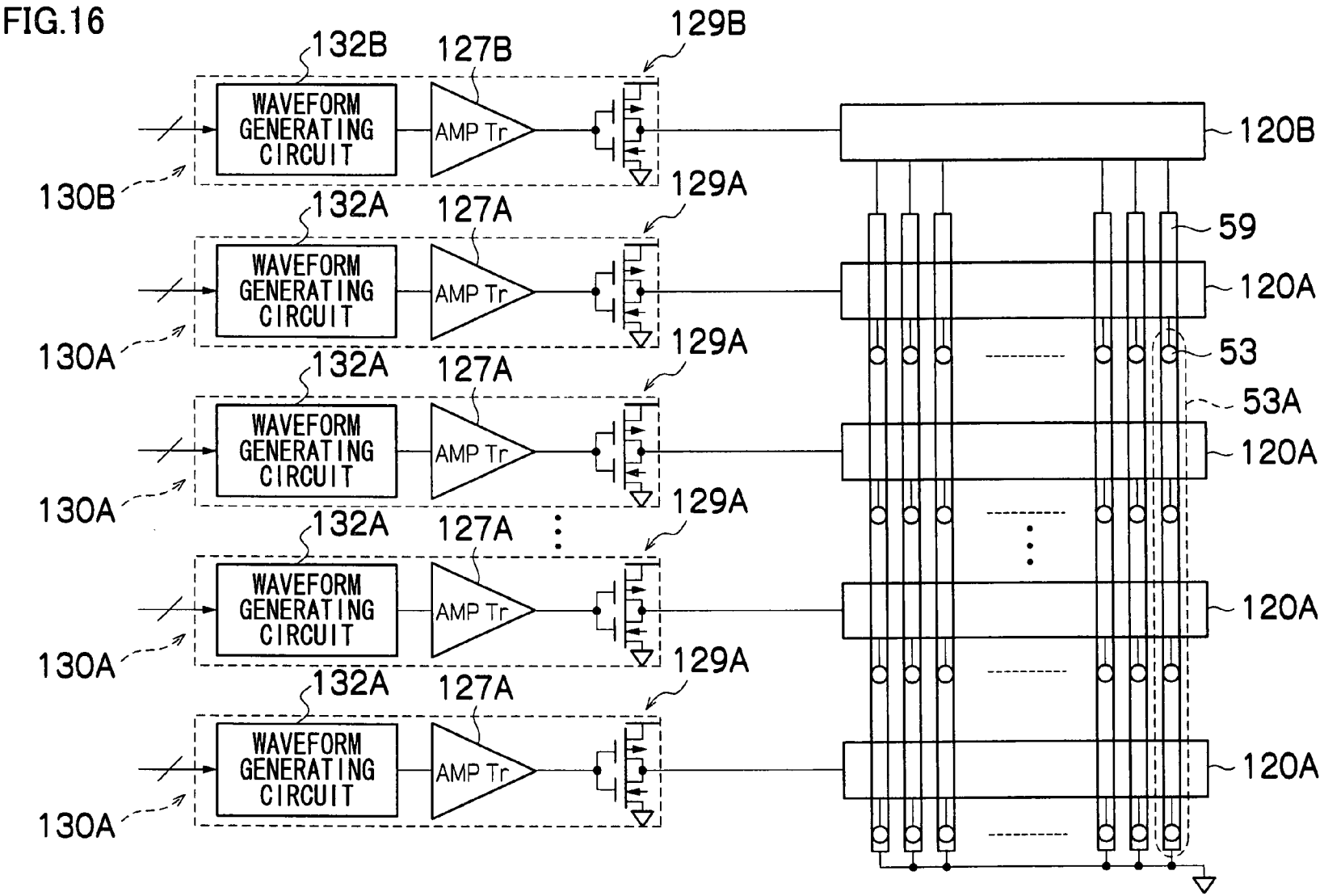
FIG. 16 is a block diagram showing the composition of a heater drive circuit according to a first embodiment of the present invention.

FIG. 16 shows a mode where the ejection drive circuit 130A for generating the drive signals to be applied to the ejection elements 53, and the heater drive circuit 130B for generating the drive signals to be applied to the heaters 59, are provided separately. The ejection drive circuit 130A and the heater drive circuit 130B shown in FIG. 16 are equivalent to the drive circuit 130 shown in FIG. 9.

As shown in FIG. 16, the heater drive circuit 130B comprises a waveform generating circuit 132B for generating a heater drive signal waveform, an amplifier circuit 127B, and a push-pull circuit 129B, and has the similar composition as the drive circuit 130 described with reference to FIG. 11. The heater drive signals are supplied from the heater drive circuit 130B to the heaters 59 through the switching IC 120B. The ejection drive circuit 130A has the same composition as the drive circuit 130 shown in FIG. 11, and the description thereof is omitted here.

Figure 17A:
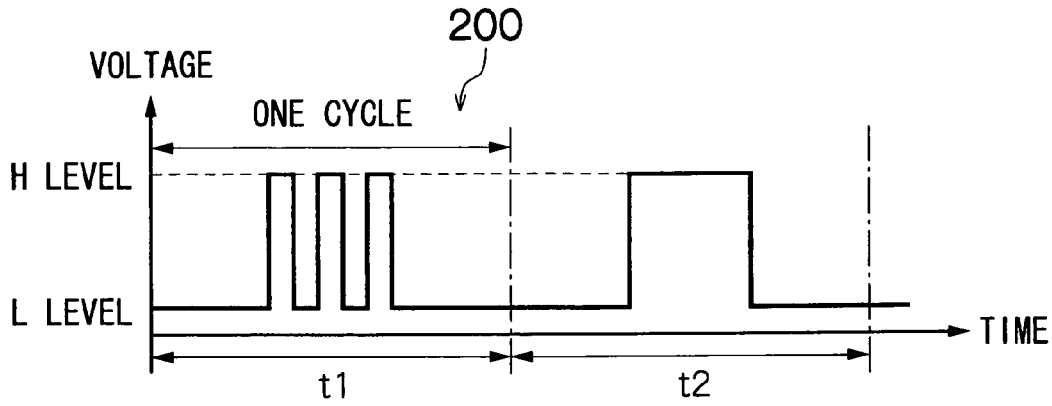
FIGS. 17A to 17C are diagrams illustrating embodiments of heater drive signals.
Figure 17B:
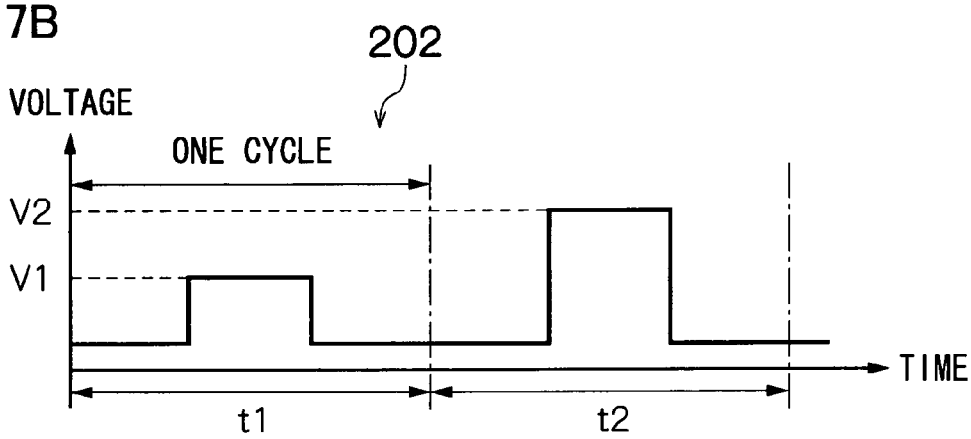
Figure 17C:
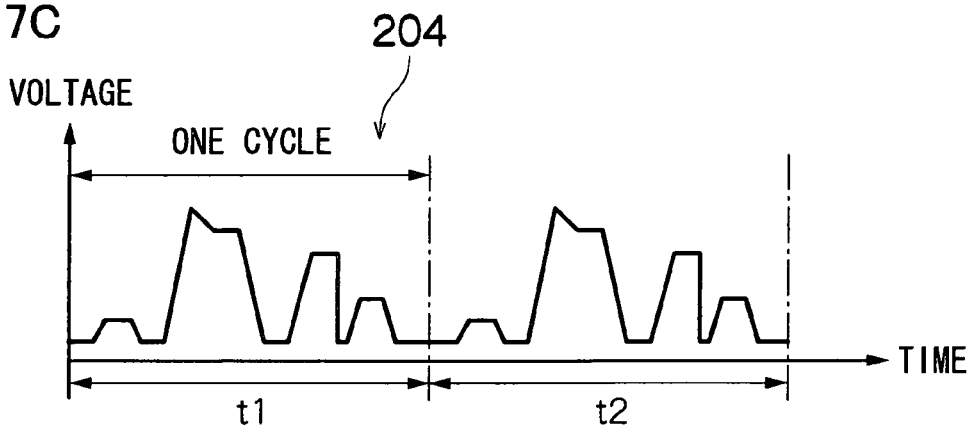

FIGS. 17A to 17C show embodiments of heater drive signals that are supplied to the heaters 59. FIG. 17A shows a heater drive signal 200 subjected to pulse width modulation (PWM) control, FIG. 17B shows a heater drive signal 202 subjected to amplitude modulation control (variable voltage control), and FIG. 17C shows a heater drive signal 204 which is also used as the drive signal supplied to the ejection elements 53.

If the heater drive signal is subjected to pulse width modulation control as shown in FIG. 17A, the voltage supplied to the heater 59 is kept constant, and the amount of heat generated by the heater 59 is controlled by altering the on duty within one cycle (namely, the powered-on duration of the heater per cycle). In other words, in order to increase the amount of heat generated by the heater 59, the on duty is increased, and in order to reduce the amount of heat generated by the heater 59, the on duty is reduced. The time period t1 indicated in FIG. 17A has approximately ½ of the on duty compared to the time period t2, and therefore, the amount of heat generated by the heater 59 in the time period t1 is approximately ½ of the heat generated by the heater 59 in the time period t2. By means of pulse width modulation control of this kind, the amount of heat generated by the heater 59 becomes a maximum at full duty, and it becomes a minimum (zero), when the on duty is zero.

In the heater drive signal 202 subjected to amplitude control as shown in FIG. 17B, the on duty during each cycle is set to a constant, and the amount of heat generated by the heater 59 is controlled by altering the voltage applied to the heater 59. Since the relationship between the voltage V1 applied to the heater 59 during the time period t1 and the voltage V2 applied to the heater 59 during the time period t2 satisfies the relationship V1=V2/2, then the amount of heat generated by the heater 59 during the time period t1 is approximately ¼ of the heat generated by the heater 59 during the time period t2.

Next, the drive control of the heaters 59 is described in detail with reference to FIGS. 18A to 18D.

Figure 18A:
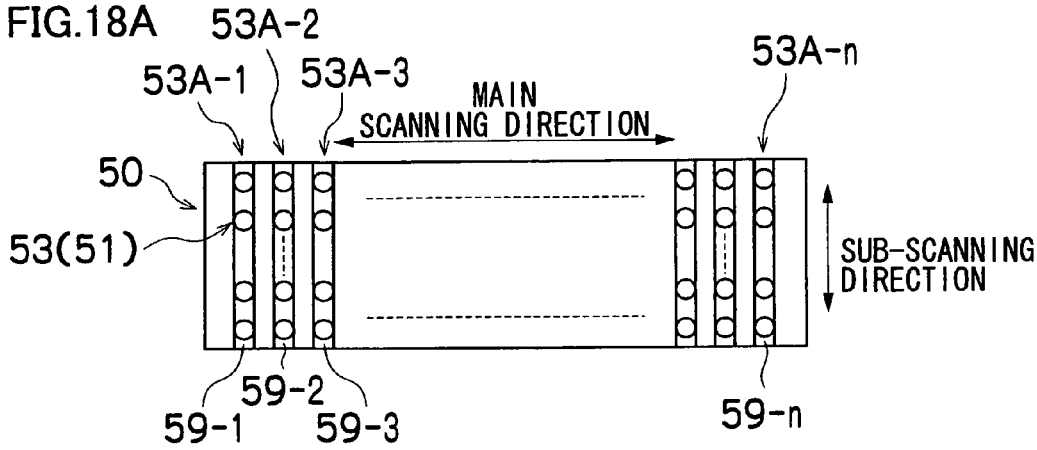
FIGS. 18A to 18D are diagrams illustrating heater drive control.

In the head 50 shown in FIG. 18A, n ejection element groups 53A-1, 53A-2, 53A-3, . . . , 53A-*n* are arranged in the main scanning direction, from the left-hand side in FIG. 18A, and n heaters 59-1, 59-2, 59-3, . . . , 59-*n* having substantially the same length as the length of the head 50 in the sub-scanning direction are arranged in the main scanning direction, so as to correspond to the respective ejection element groups 53A. The length of the heaters 59 should be equal to or greater than the length of the ejection element groups 53A in the direction substantially parallel to the sub-scanning direction, and it may be shorter than the length of the head 50 in the sub-scanning direction.

Figure 18B:
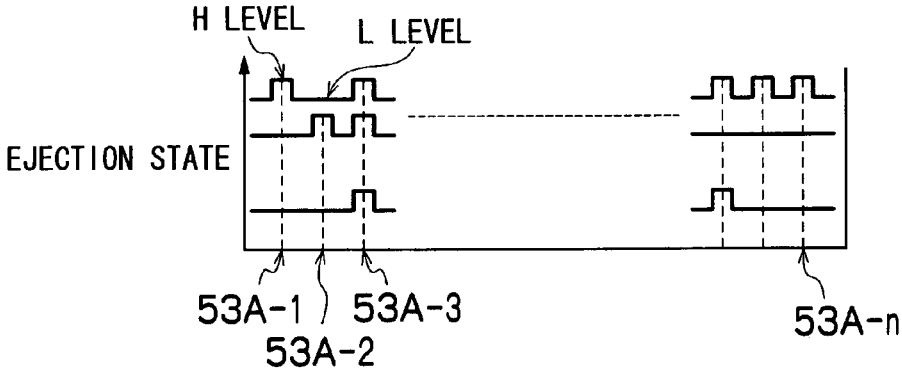
Figure 18C:
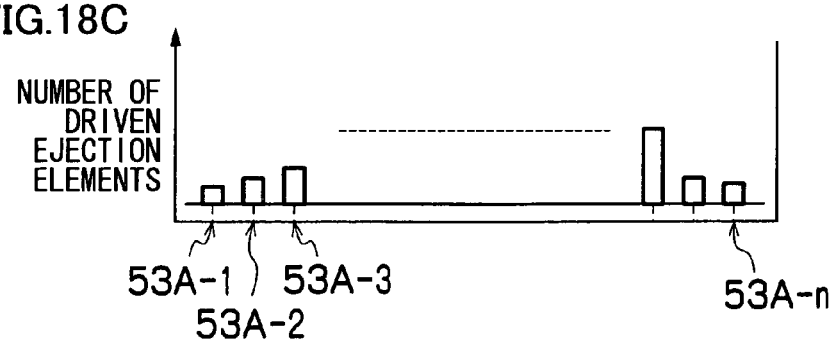
Figure 18D:
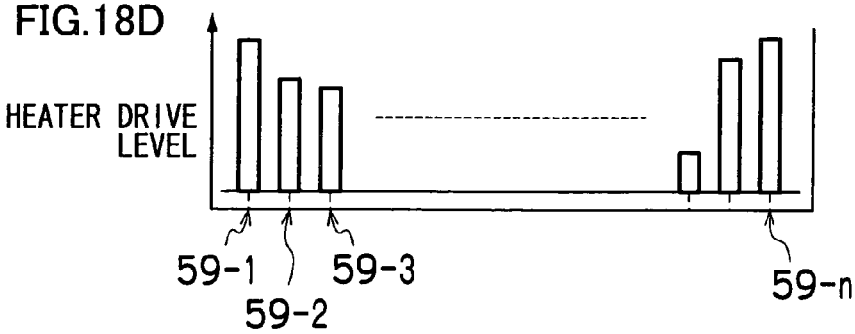

FIG. 18B shows the ejection state of each of the ejection element groups 53A based on particular image data, and FIG. 18C shows the number of driven ejection elements in each of the ejection element groups 53A, as determined on the basis of the ejection state shown in FIG. 18B. The vertical direction in FIG. 18B is the sub-scanning direction, and the horizontal direction indicates the main scanning direction. The H level represents an ejection element that is to be driven. When the numbers of driven ejection elements in the ejection element groups 53A have been determined in this way, the drive levels of the heaters 59 shown in FIG. 18D are determined on the basis of these numbers of driven ejection elements, and heater drive signals applied to the heaters 59 are set according to these heater drive levels.

For example, when using the heater drive signal 200 based on pulse width modulation control such as that shown in FIG. 17A, since the ejection element group 53A-1 has a smaller number of driven ejection elements than the ejection element group 53A-2, then the heater drive level for the ejection element group 53A-1 is greater than the heater drive level for the ejection element group 53A-2, and therefore, the drive signal having a higher on duty is applied to the heater 59-1 than to the heater 59-2. Furthermore, when using the heater drive signal 202 based on amplitude modulation control as shown in FIG. 17B, the drive signal having a higher voltage (amplitude) is applied to the heater 59-1 than to the heater 59-2. Moreover, when using the heater drive signal 204 also serving as the ejection drive signal as shown in FIG. 17C, the drive signal corresponding to a large ejection volume is applied to the heater 59 having a high drive level and the drive signal corresponding to a small ejection volume is applied to a heater 59 having a low drive level, in such a manner that the drive signal corresponding to a medium dot is applied to the heater 59-1, and the drive signal corresponding to a small dot is applied to the heater 59-2.

Figure 19:
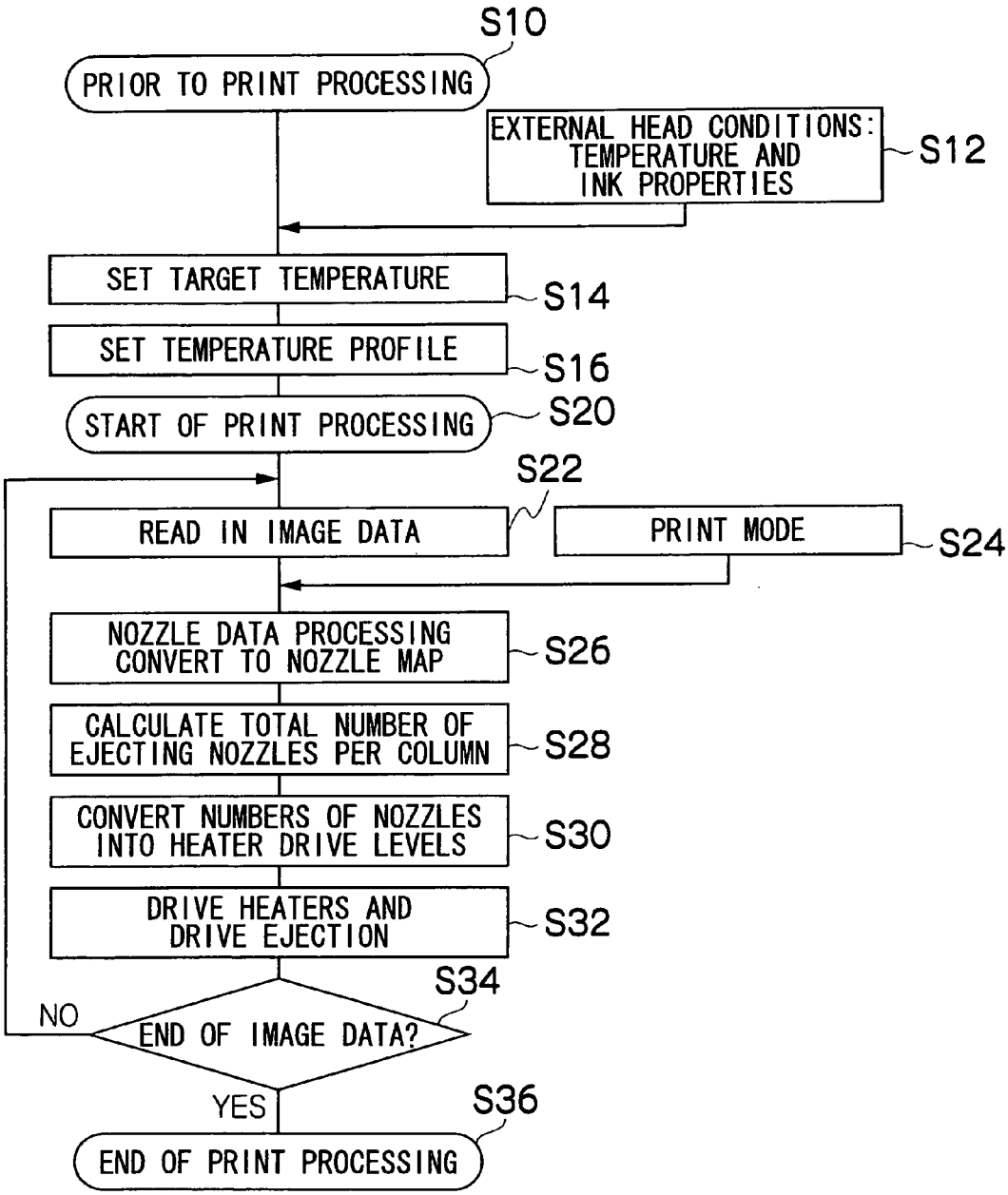
FIG. 19 is a flowchart showing a sequence of heater drive control according to the first embodiment of the present invention.

FIG. 19 shows a flowchart of the drive control of the heaters 59 during printing.

Before the printing process (for example, during a printing interval period) (step S10), firstly, the external conditions of the head are acquired (step S12). Here, the "external conditions of the head" include the environmental conditions, such as the external temperature of the head (peripheral temperature), and the ink conditions, such as the ink properties (type of ink).

Next, the target temperature of the ink inside the head 50 is set on the basis of the external head conditions acquired at step S12 (step S14), and a temperature profile for achieving this target temperature is set (step S16).

Figure 20A:
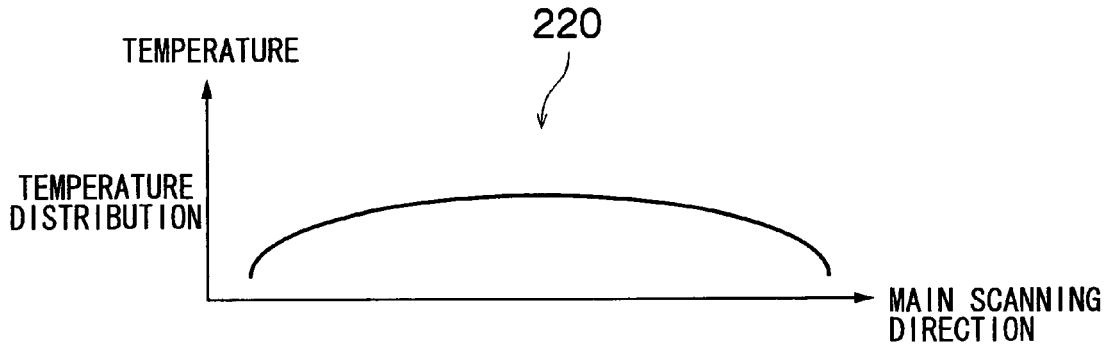
FIG. 20A is a diagram showing a temperature distribution in the head.
Figure 20B:
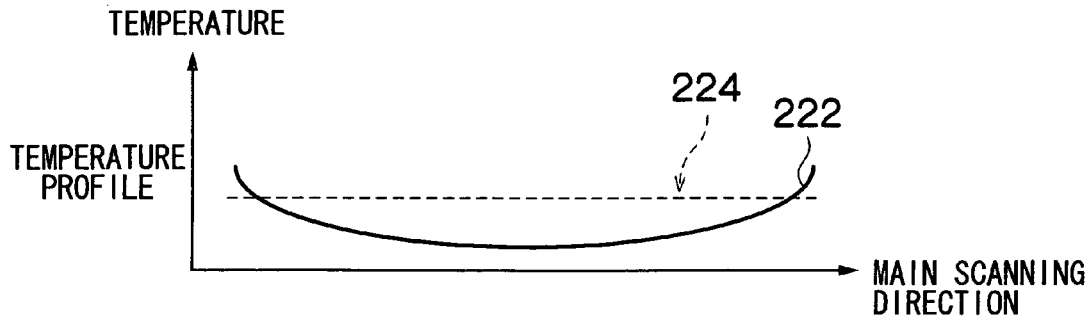
FIG. 20B is a diagram showing a temperature profile in the head.

FIG. 20B shows one embodiment of a temperature profile set at step S16. In a line head, ink is ejected more frequently from the nozzles in the central region of the head compared with the nozzles in the end regions, and hence there is a tendency for the temperature of the head to become higher in the central region than in the end regions. In other words, a temperature distribution 220 such as that shown in FIG. 20A may occur inside the head (and the ink inside the head). A temperature profile 222 as shown in FIG. 20B is set in order to cancel out (compensate) this temperature distribution 220. When the temperature profile 222 shown in FIG. 20B has been set, the driving of the heaters 59 is controlled in such a manner that the drive level of the heaters 59 in the end regions of the head, and the vicinity thereof, is higher than the drive level of the heaters 59 in the central region of the head and the vicinity thereof. Of course, it is also possible to set a uniform temperature profile 224 for the whole of the region in the main scanning direction, as indicated by the broken line in FIG. 20B.

Thereupon, when print processing is started (step S20 in FIG. 19), the image data is read in (step S22) and the set print mode is read in (step S24), whereupon the procedure advances to step S26. At step S26, nozzle data processing (dot data generation) is carried out in accordance with the print mode read in at step S24, on the basis of the image data read in at step S22. The image data is thereby converted to a nozzle map. The nozzle map generated at step S26 corresponds to the ejection states shown in FIG. 18B.

The number of driven ejection elements shown in FIG. 18C is calculated on the basis of the nozzle map determined at step S26 in FIG. 19 (step S28 in FIG. 19), and the procedure then advances to step S30. At step S28, the total number of nozzles that are selected to be driven (to eject ink) from the nozzles in each column is calculated.

At step S30, the heater drive levels (shown in FIG. 18D) are determined on the basis of the temperature profile set in step S 16, on the basis of the numbers of driven ejection elements (total numbers of ejecting nozzles) determined at step S28. In other words, at step S30 in FIG. 19, the total numbers of ejecting nozzles in the columns, as calculated at step S28, are converted into the drive levels for the heaters 59.

When the heater drive levels have been determined in this way, the drive signals generated on the basis of the heater drive levels are applied respectively to the heaters 59, and furthermore, ejection of ink is controlled in order to print the desired image (step S32). Thereupon, it is judged whether or not the image data has ended (whether or not there is subsequent image data) (step S34), and if the image data has not ended (NO verdict), then the procedure advances to step S22, whereas if the image data has ended (YES verdict), then the print processing terminates (step S36).

The various types of analysis, judgment and calculation in the flowchart may be carried out by means of a CPU or image processing LSI installed in the inkjet recording apparatus 10, or they may be carried out by the host computer 86, or, of course, the processing may be shared between same.

Figure 21A:
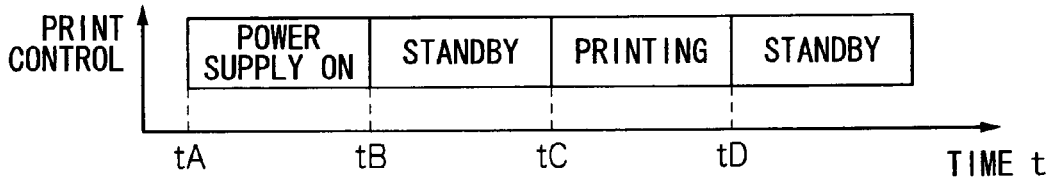
FIGS. 21A to 21C are diagrams illustrating the relationship between print control, ejection drive control and heater drive control.
Figure 21B:
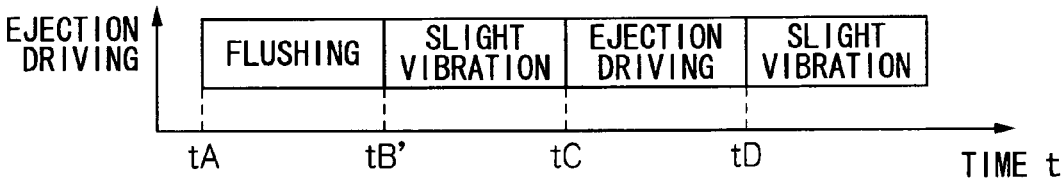
Figure 21C:
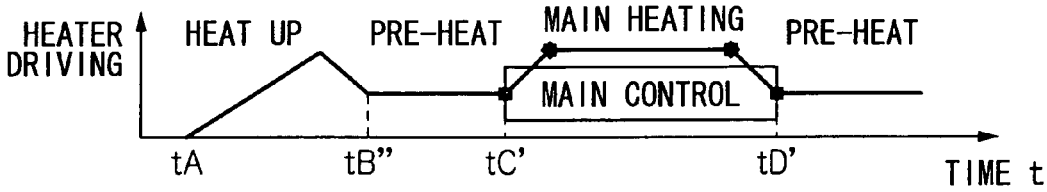

Here, FIGS. 21A to 21C show the relationship between the print control, ejection driving and heater driving. FIG. 21A shows the sequence of print control, FIG. 21B shows the sequence of ejection driving, and FIG. 21C shows the sequence of heater driving.

In the print control shown in FIG. 21A, when the power supply switches on at timing tA, initialization is performed in the time period from the power switch-on time (timing tA) to timing of tB. The time period from the timing tB until timing tC when printing starts is a standby period, and when the printing has ended at timing tD, the time period until the start of the next printing operation is also a standby period. In other words, the period before the printing process shown in step S10 in FIG. 19 is the time period from the timing tA until the timing tB in FIGS. 21A to 21C.

In the ejection control shown in FIG. 20B, in the time period from the timing tA when the power is switched on, until timing tB', restoration operations, such as flushing (purging) and suctioning, are carried out. The timing tB' which indicates the end of flushing may be the same timing as the end timing tB of the initialization processing in the print control shown in FIG. 21A, or the timing tB' may be a different timing from the timing tB.

Furthermore, in the ejection control, during the time period from the flushing end timing tB' until the ink ejection start timing tC (which coincides with the print start timing shown in FIG. 21A), control is implemented in such a manner that the meniscus is caused to slightly vibrate. By causing the meniscus to vibrate to a level which does not cause ink to be ejected from the nozzle 51, increase in the viscosity of the ink in the nozzle 51 is suppressed. Moreover, control for causing slight vibration of the meniscus is also implemented in the time period from the ejection drive end timing tD (which coincides with the print end timing in FIG. 21A) until the start of the next ejection operation.

In the heater driving shown in FIG. 21C, in the time period from the power switch-on timing tA until timing tB", the head 50 (the ink inside the head 50) is heated up in such a manner that the ink assumes a temperature suitable for printing (ejection). At the timing tB", when the ink in the head 50 has reached the prescribed temperature, pre-heating is carried out in order to maintain this temperature. The timing tB" may be the same as the initialization end timing tB shown in FIG. 21A, or the flushing end timing tB' shown in FIG. 21B.

Furthermore, in the heater driving, in the time period from timing tC' slightly earlier than the ejection start timing tC shown in FIG. 21B, until timing tD' slightly later than the ejection drive end timing tD, main heating is carried out using the heater drive control (main control) according to the embodiment of the present invention.

In general heating control in the related art, when a print command is issued, the ink inside the head is heated from the pre-heated state to a temperature suitable for printing, and during printing, the driving of the heaters is controlled in such a manner that the ink inside the head 50 is heated by a uniform amount of heat, or is heated gently over a relatively long period of time. In general heating control of this kind, there may be a temperature distribution in the head 50 (the ink inside the head 50), depending on the ejection state during printing, and furthermore, this temperature distribution may vary from time to time.

On the other hand, in the heater drive control according to the embodiment of the present invention, since the driving of the heaters 59 is controlled in accordance with the ejection state during printing, then it is possible to control the temperature more accurately and quickly, without occasionally having to measure the temperature of the head 50 (the ink inside the head 50).

In the inkjet recording apparatus 10 having the composition described above, the numbers of driven ejection elements in the ejection element groups 53A are determined on the basis of the image data, and the heaters 59 are controlled in accordance with these driven ejection element numbers. Therefore, it is possible to keep the ink inside the head 50 at a constant temperature, without having to measure the temperature occasionally by means of temperature sensors. Therefore, desirable ink ejection which avoids local occurrence of ejection abnormalities can be achieved throughout the whole of the region where the ejection elements 53 (nozzles 51) are provided in the head 50.

Furthermore, since the heaters 59 are disposed in the head 50 in a substantially parallel direction with respect to the paper feed direction (column direction), then it is possible to control the temperature of the head 50 in column units of the ejection elements 53, which are arranged two-dimensionally. Therefore, the number of heaters can be reduced and the size of the heater drive circuit can be reduced, in comparison with a case where each ejection element 53 has its own heater.

Second Embodiment

Next, the driving control of the heaters 59 according to a second embodiment of the present invention is described. The head 50 according to the present embodiment has substantially the same composition as the head 50 of the first embodiment described above, and therefore description thereof is omitted here.

Figure 22A:
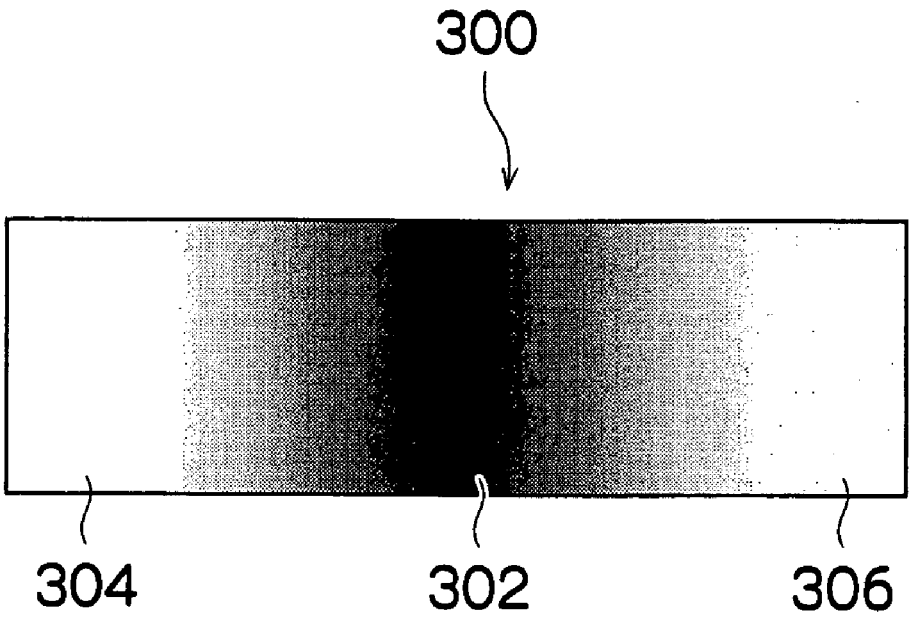
FIG. 22A is a diagram showing an example of shading in a solid image.
Figure 22B:
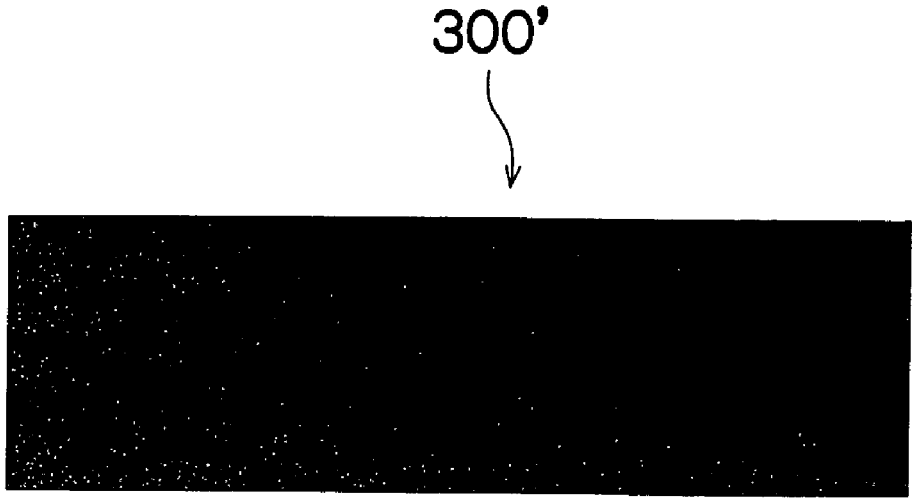
FIG. 22B is a diagram showing a solid image having uniform density.

FIG. 22A shows an image 300 in which shading (localized density non-uniformity) occurs in a solid image. In the image 300, due to the effects of the temperature distribution in the head 50 (the temperature distribution in the ink inside the head 50) resulting from the structure of the head 50, a density non-uniformity occurs whereby the end regions 304 and 306 have lower density than the central region 302. FIG. 22B shows a solid image 300' which has uniform density throughout the whole of the region that is supposed to be printed.

In general, in a line head, the surface area in contact with the external air is greater in the peripheral regions than in the central region of the head, and hence the heat radiating effects are greater. Therefore, there is a tendency for a temperature distribution to occur in which the temperature is lower in the peripheral regions of the head than in the central region of the head. A temperature distribution is especially liable to occur in the main scanning direction (the lengthwise direction of the head). If a temperature distribution of this kind occurs due to the structure of the head, then the ink viscosity is higher in the peripheral regions of the head than in the central region thereof, and the amount of ink ejected from the peripheral regions of the head where the ink viscosity is higher becomes lower than the prescribed ejection volume. Therefore, shading such as that shown in FIG. 22A may occur in the printed image.

In the drive control for the heaters 59 according to the present embodiment, a temperature profile is set to compensate (cancel out) the temperature distribution of this kind, and the driving of the heaters 59 is controlled on the basis of the temperature profile thus set. The temperature distribution described above is similar to the temperature distribution 220 shown in FIG. 20A, and hence the temperature profile 222 such as that shown in FIG. 20B is set to correct the temperature distribution shown in FIG. 20A, and the heaters 59 are controlled on the basis of this temperature profile 222.

In other words, the drive levels of the heaters 59 in the end regions of the head 50, in terms of the main scanning direction, and the vicinity thereof, are controlled so as to be higher than the drive levels of the heaters 59 in the approximate central region of the head 50 in terms of the main scanning direction, and the vicinity thereof. Therefore, the temperature becomes uniform throughout the whole ejection region of the head 50, and desirable ejection is achieved from all of the ejection elements 53 (nozzles 51) provided in the head 50.

Figure 23A:
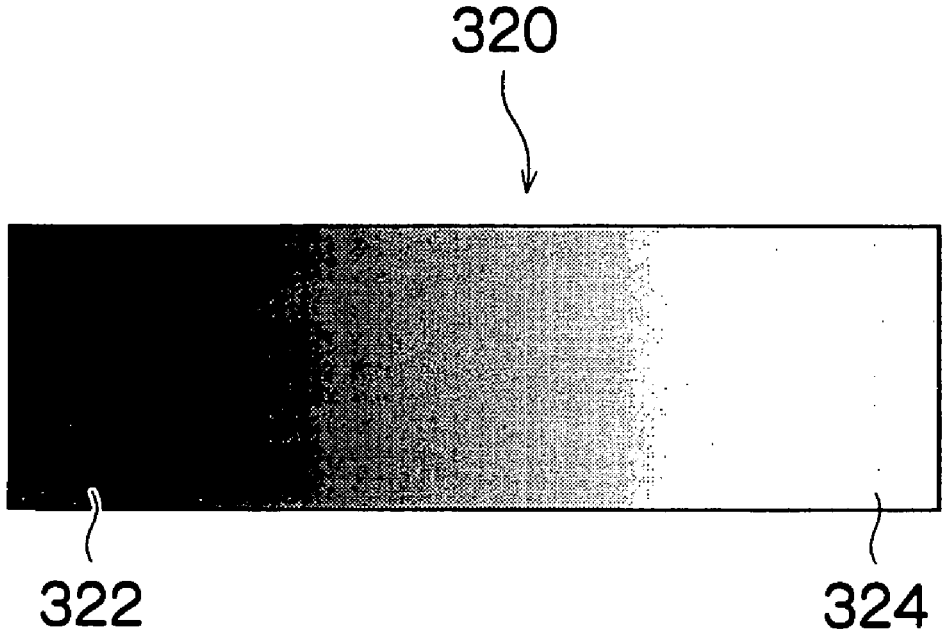
FIG. 23A is a diagram showing another example of shading in a solid image.
Figure 23B:
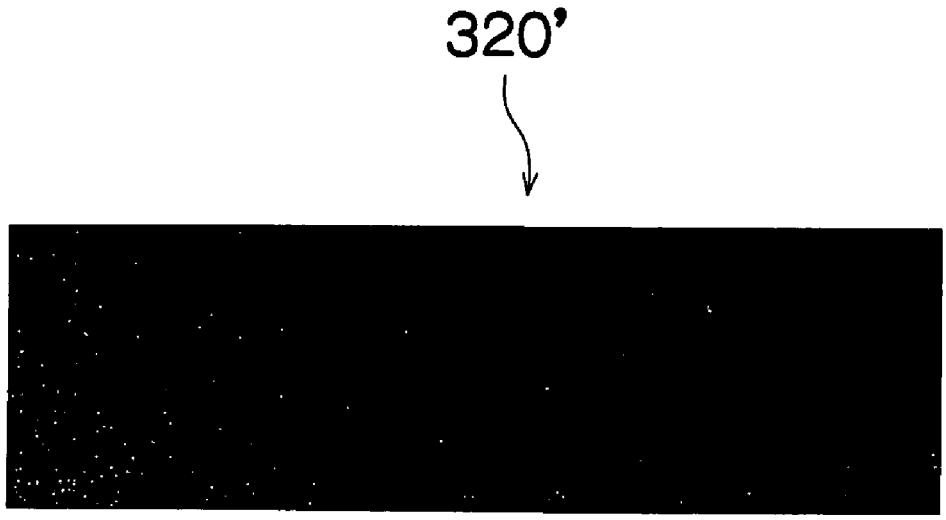
FIG. 23B is a diagram showing a solid image having uniform density.

FIG. 23A shows an image 320 which has a shading whereby the density gradually becomes lower from one end region toward the other end region. In the image 320, a density non-uniformity occurs whereby the density reduces from the left-hand end 322 toward the right-hand end 324 in FIG. 23A. FIG. 23B shows a solid image 320' which has uniform density through the whole of the region that is supposed to be printed.

If the head is filled with ink that has been heated previously outside of the head, then the temperature of the ink falls in the regions that are distant from the refilling port, compared to regions that are near to the refilling port, and therefore a temperature distribution occurs in the ink inside the head. In the head 50 of the present embodiment, ink is filled into the head from one of the end sections of the head 50 in the lengthwise direction. In other words, a refilling port is provided in one of the two end sections of the head 50 in the lengthwise direction, and the ink introduced through this refilling port declines in temperature as it passes through the head, and the ink temperature is lowest at the opposite end to the refilling port.

Figure 24A:
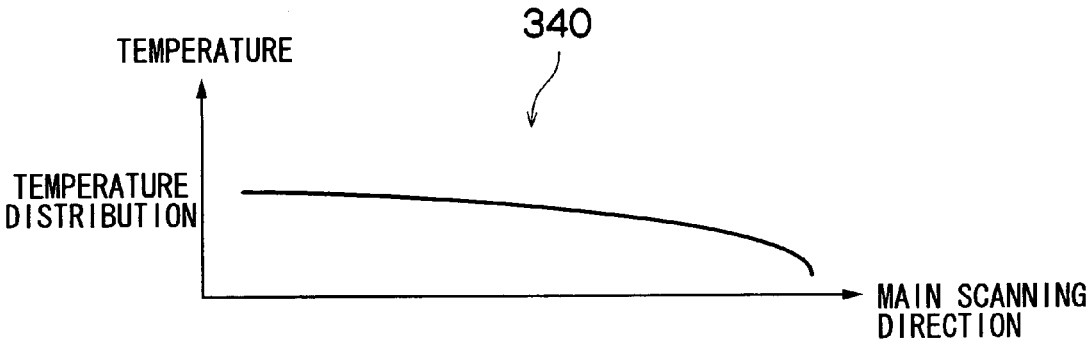
FIG. 24A is a diagram showing a temperature distribution in the head in the case of the shading shown in FIG. 23A.

More specifically, if there is a temperature distribution 340 in the head 50 as shown in FIG. 24A, then shading such as that shown in FIG. 23A occurs in the printed image.

Figure 24B:
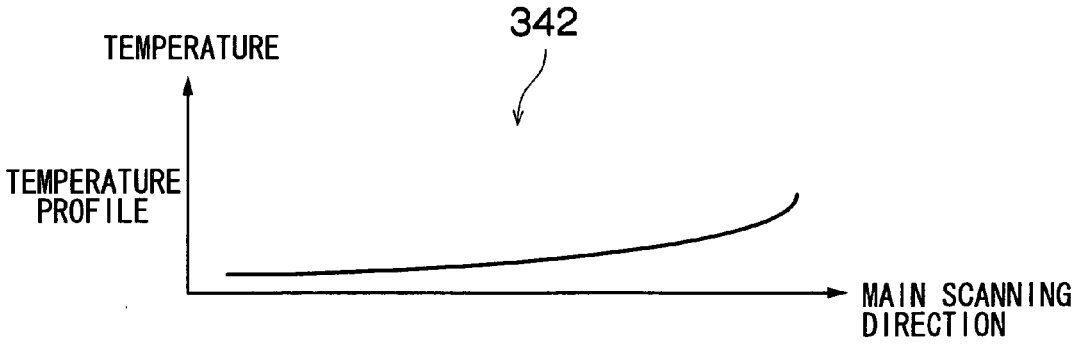
FIG. 24B is a diagram showing a temperature profile for eliminating the shading shown in FIG. 23A.

In the heater drive control according to the present embodiment, if the temperature distribution 340 as shown in FIG. 24A occurs in the ink inside the head 50, then a temperature profile 342 as shown in FIG. 24B is set in order to correct this temperature distribution 340, and the driving of the heaters 59 is controlled on the basis of the temperature profile 342.

In other words, the drive levels of the heaters 59 at one end of the head 50 in the main scanning direction (the near end to the refilling port), and the drive levels of the heaters 59 in the vicinity of this region, are controlled so as to be lower than the drive levels of the heaters 59 at the other end (the far end from the refilling port) and the heaters 59 in the vicinity of this region. Therefore, the temperature of the ink inside the head 50 becomes uniform through the whole of the region where the ejection elements are disposed.

Figure 25:
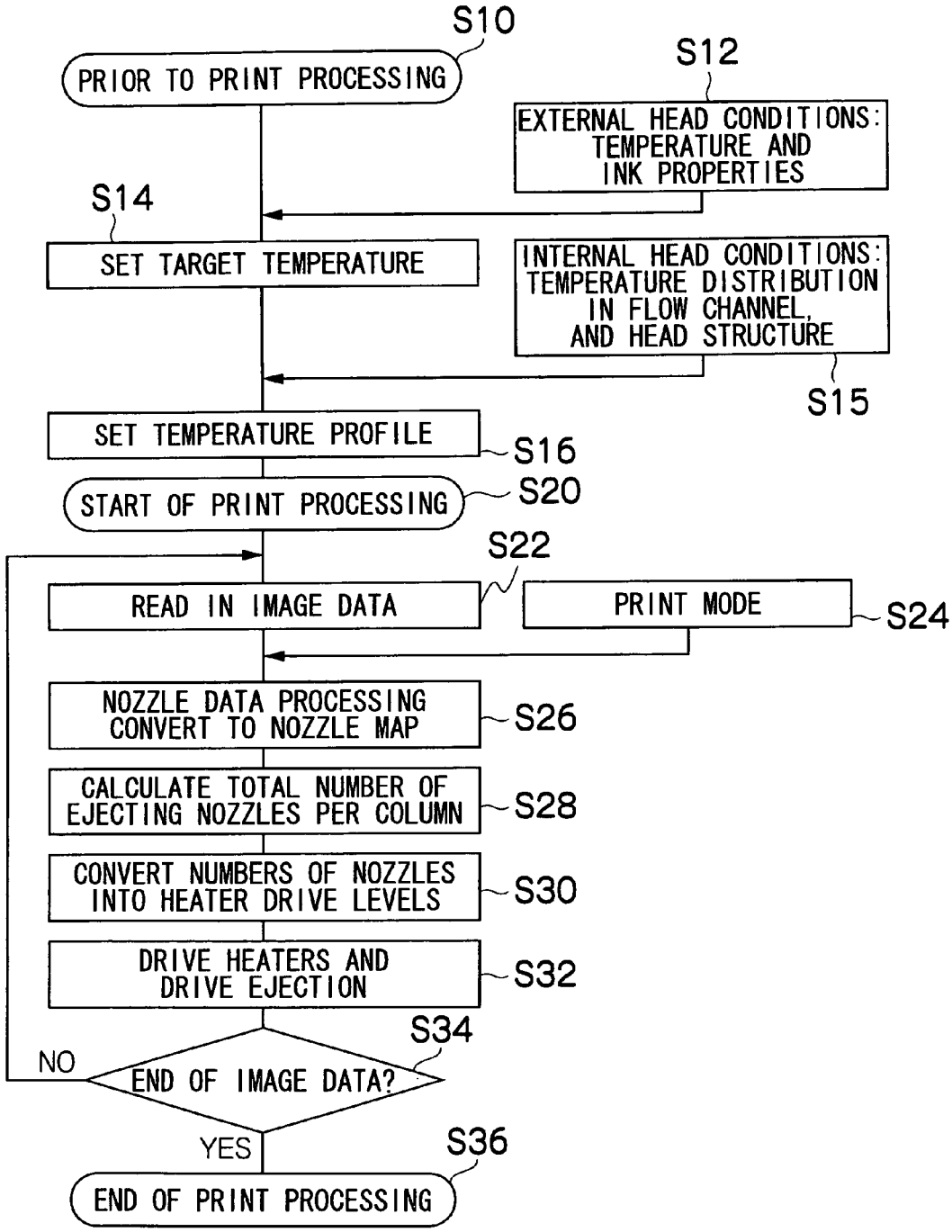
FIG. 25 is a flowchart showing a sequence of heater drive control according to a second embodiment of the present invention.

FIG. 25 shows a flowchart of the heater drive control according to the present embodiment. In FIG. 25, the steps which are the same as or similar to those in FIG. 19 are denoted with the same reference numerals and description thereof is omitted here. In the heater drive control shown in FIG. 25, when a target temperature has been established at step S14, the internal conditions of the head are referenced (step S15), and a temperature profile is set on the basis of these internal head conditions (step S16). Here, "internal head conditions" include conditions such as the internal structure of the head 50. The temperature profile is set in order to correct the temperature distribution occurring inside the head as a result of the internal head conditions.

It is also possible to adopt a composition in which a data table is previously stored which associates a plurality of internal head conditions with a plurality of temperature profiles for correcting the temperature distribution corresponding to those internal head conditions, in such a manner that a suitable temperature profile is read out from the data table and set.

In the inkjet recording apparatus 10 having this composition, the temperature profile is set in order to correct the temperature distribution of the head 50 in the main scanning direction, and the temperature distribution of the ink inside the head 50. Then, the heaters 59, which are formed in a substantially parallel direction to the paper feed direction and are aligned in the main scanning direction, are controlled and driven on the basis of this temperature profile. Therefore, the temperature distribution of the head 50 and the ink inside the head 50 arising from the internal conditions of the head is corrected, and the ink temperature becomes uniform throughout the whole of the region where the ejection elements are disposed in the head 50. Consequently, desirable ink ejection is performed from all of the ejection elements 53 provided in the head 50 and the occurrence of shading such as that shown in FIGS. 21A and 23A can be avoided in the printed image.

Adaptation Embodiment 1

Figure 26:
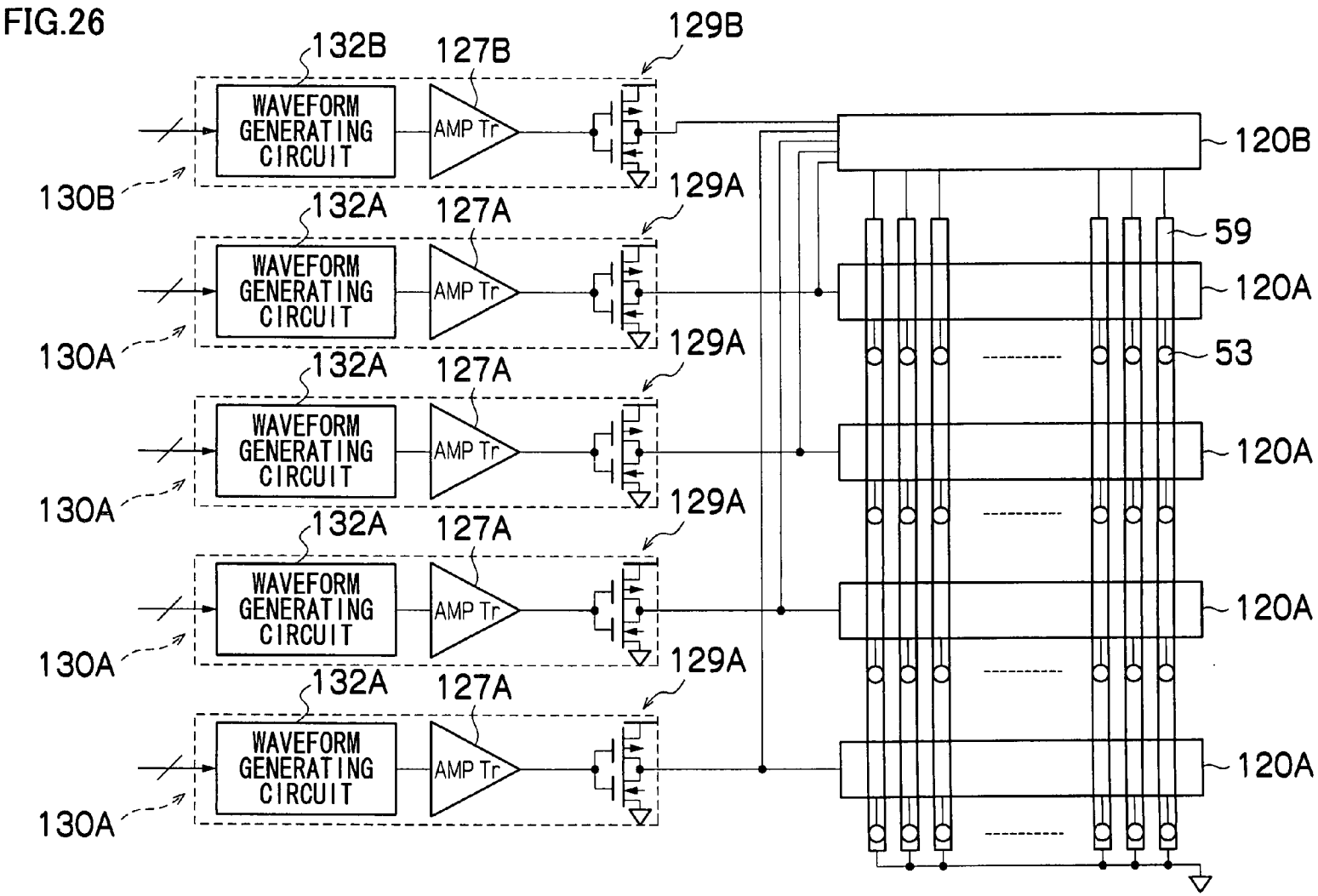
FIG. 26 is a block diagram showing the composition of a heater drive circuit according to a first adaptation of the present invention.
Figure 27:
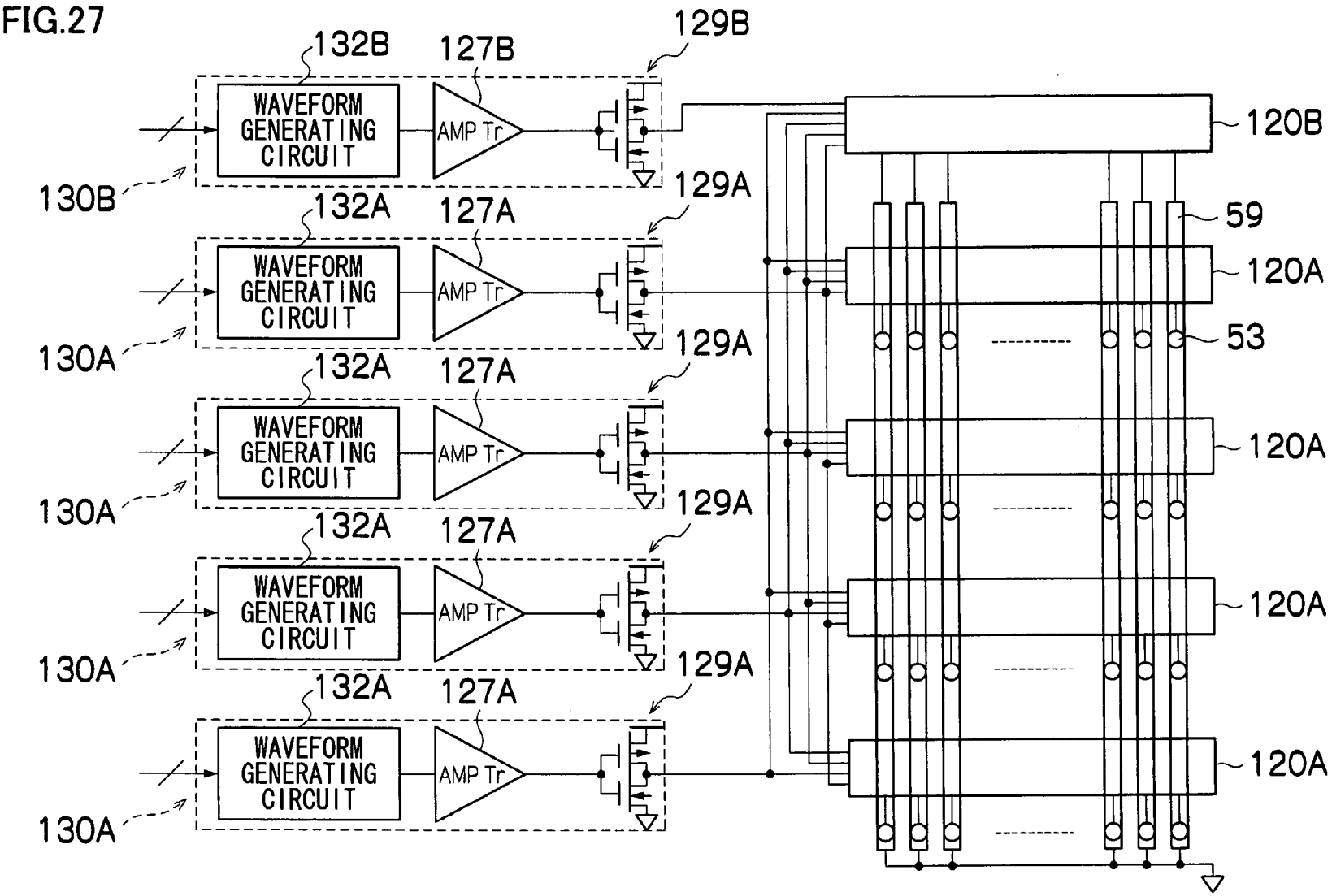
FIG. 27 is a block diagram showing a further mode of the heater drive circuit shown in FIG. 26.

FIGS. 26 and 27 show the general compositions of drive circuits of the heaters 59 according to adaptations of the first and second embodiments described above.

As shown in FIG. 26, the outputs of the ejection drive circuits 130A are connected to the heaters 59 through the switching IC 120B (the switching elements of the switching IC 120B), and by controlling the switching IC 120B, it is possible to assign a portion (or all) of the drive capacity (drive energy) of the ejection drive circuits 130A to the driving of the heaters 59. By adopting a composition of this kind in which the heater drive circuit 130B can be supplemented by using the ejection drive circuits 130A, it is possible to reduce the size of the circuit of the heater drive circuit 130B. In other words, the drive capacity of the ejection drive circuits 130A is used for driving the heaters 59 when the number of nozzles (ejection elements) to be driven is small.

The drive capacity of the ejection drive circuits 130A is designed in such a manner that in addition to driving the ejection elements 53 (nozzles 5 1), they are also capable of driving dummy loads, or the like, provided in order to suppress variation (waveform distortion, etc.) in the drive signal due to variation in the capacitive loads. By employing this surplus drive capacity as the drive power for the heaters 59, it is possible to reduce the power consumption of the overall circuit used to drive the ejection elements 53 and heaters 59.

FIG. 27 shows a composition in which each of the outputs of the ejection drive circuits 130A is connected to all the switching ICs 120A. In the composition shown in FIG. 27, since all of the drive elements in the head 50 can be driven selectively by each of the ejection drive circuits 130A, then it is possible to keep the drive loads of the ejection drive circuits 130A at a uniform level, thereby reducing variations in the drive signals due to load variations between different ejection drive circuits 130A. Consequently, non-uniformities in ink ejection are reduced and improved quality in the printed image can be expected.

By adopting a composition of this kind, it is possible to reduce the size of the circuit of the ejection drive circuits 130A (and the heater drive circuit 130B), as well as reducing the power consumption (current consumption) per ejection drive circuit 130A (heater drive circuit 130B). Therefore, a greater range of transistors can be selected for use in the power amplification units, and the like, and furthermore, transistors capable of high-speed switching, which is an important characteristic in waveform generation, can be employed. The number of drive circuits can be designed suitably in accordance with various factors, such as the number of actuators, the ejection performance, the circuit size, costs, and the like.

In the compositions shown in FIGS. 26 and 27, the ejection drive signals applied to the ejection elements 53 also serve as the heater drive signals applied to the heaters 59, as shown in FIG. 17C.

Figure 28:
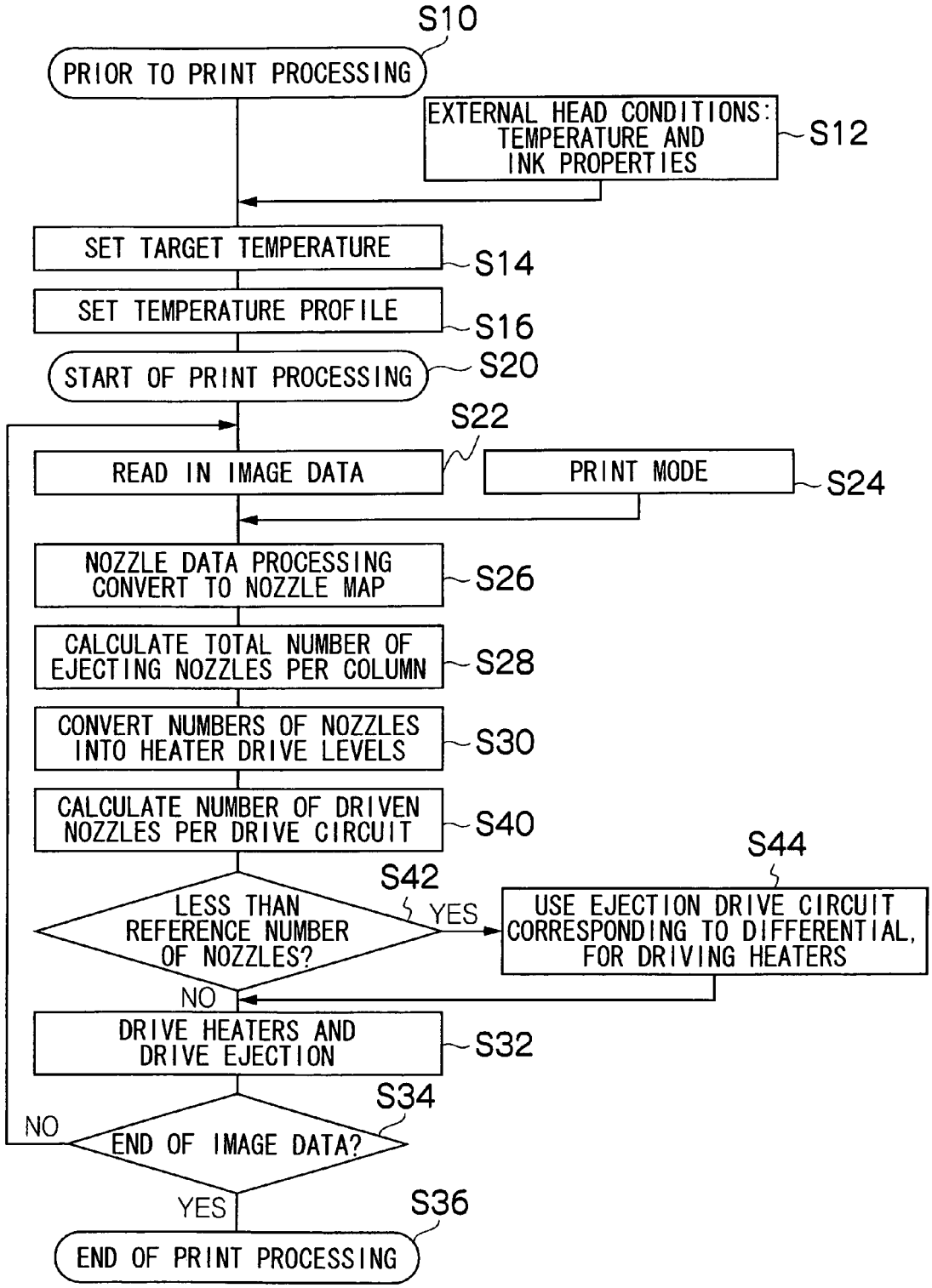
FIG. 28 is a flowchart showing a sequence of heater drive control according to the first adaptation of the present invention.

FIG. 28 is a flowchart of the drive control for the heaters 59 in the composition shown in FIG. 27. In FIG. 28, the steps which are the same as or similar to those in FIG. 19 are denoted with the same reference numerals and description thereof is omitted here.

As shown in FIG. 28, when the drive levels of the heaters 59 are calculated at step S30, the number of ejection elements (number of nozzles) to be driven by each ejection drive circuit 130A is calculated (step S40), and this number of ejection elements is compared with a prescribed reference number of ejection elements (step S42). At step S42, if the number of ejection elements actually driven is smaller than the reference number of ejection elements (YES verdict), then the switching IC 120B is controlled in such a manner that the drive capacity corresponding to the differential between the reference number of ejection elements and the number of ejection elements actually driven is used to drive the heaters 59 (step S 44).

On the other hand, if, at step S42, the number of ejection elements actually driven is equal to or larger than the reference number of ejection elements (NO verdict), then the switching IC 120B is controlled in such a manner that the drive capacity of the ejection drive circuit 130A in question is used only to drive the ejection elements, and the procedure advances to step S32.

Adaptation Embodiment 2

Figure 29:
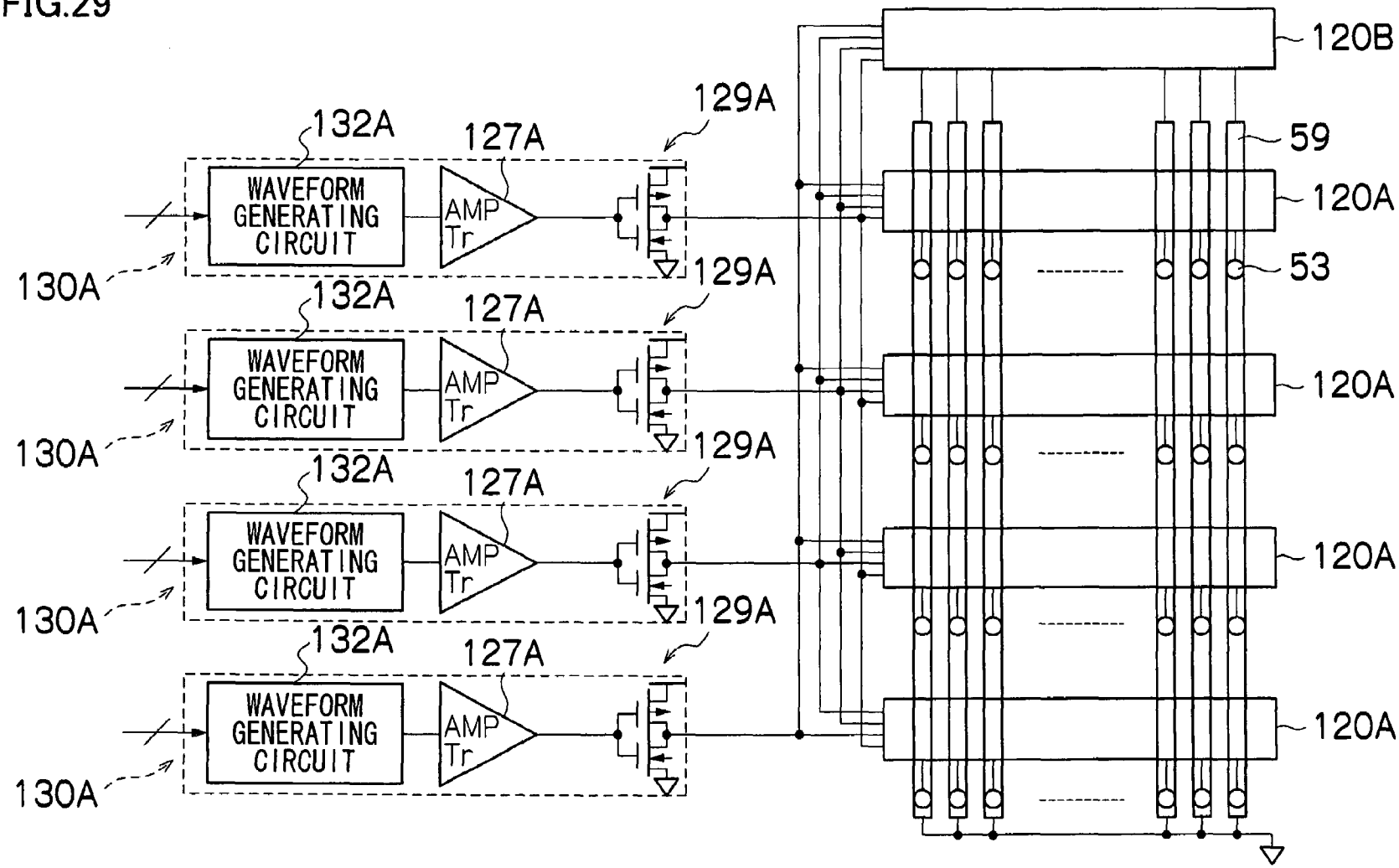
FIG. 29 is a block diagram showing the composition of a heater drive circuit according to a second adaptation of the present invention.

Next, a further adaptation is described. FIG. 29 shows the general composition of the drive circuit for heaters 59 according to a further adaptation of the first and second embodiments described above, and FIG. 30 shows a flowchart of the drive control for the heaters 59 according to this adaptation.

FIG. 29 shows a composition in which the ejection drive circuits 130A also serve as the heater drive circuits 130B. In other words, the composition shown in FIG. 29 is provided with no heater drive circuits 130B, and the outputs of the ejection drive circuits 130A are connected to the heaters 59 through the switching IC 120B. In a composition of this kind, depending on the number of ejection elements to be driven by each of the ejection drive circuits 130A, it is possible to select between states where each of the ejection drive circuits 130A drives the ejection elements 53 only, the heaters 59 only, or both the ejection elements 53 and the heaters 59. The switching ICs 120A and 120B are controlled accordingly. Moreover, the switching ICs 120A and 120B are controlled in such a manner that the loads of the ejection drive circuits 130A remain uniform.

Figure 30:
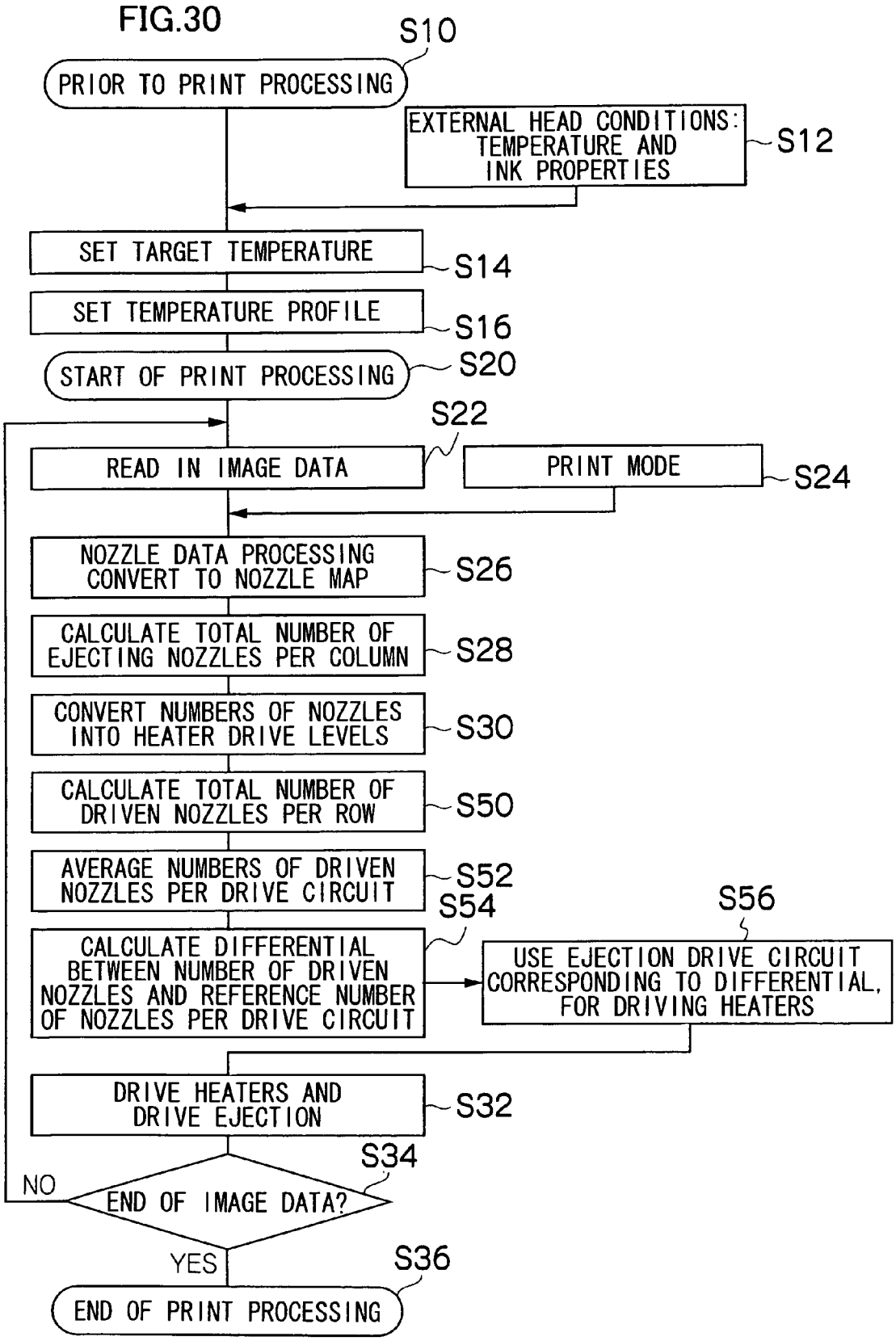
FIG. 30 is a flowchart showing a sequence of heater drive control according to the second adaptation of the present invention.

FIG. 30 is a flowchart showing the heater drive control according to the second adaptation embodiment. In FIG. 30, the steps which are the same as or similar to those in FIG. 28 are denoted with the same reference numerals and description thereof is omitted here.

In the heater drive control shown in FIG. 30, when the drive levels of the heaters 59 are calculated at step S30, the number of ejection elements 53 to be driven (the number of nozzles 51 which are to eject ink), of the ejection elements 53 (nozzles 51) aligned in a direction coinciding with the main scanning direction, is calculated (step S50), and the numbers of ejection elements (nozzles) driven by the ejection drive circuits 130A are averaged (step S52). In other words, the number of ejection elements to be driven by each ejection drive circuit 130A is determined in such a manner that the loads on the ejection drive circuits 130A are uniform.

The differential between the reference number of ejection elements (nozzles) and the thus determined number of ejection elements (number of nozzles) to be driven by each ejection drive circuit 130A, is determined (step S54), and the switching IC 120B is controlled in such a manner that the drive capacity corresponding to this differential is used to drive the heaters 59 (step S56). The procedure then advances to step S32. If the number of ejection elements actually to be driven by each of the ejection drive circuits 130A is greater than the reference number of ejection elements, then processing for changing the nozzle map generated at step S26, or the like, is carried out, in such a manner that drive capacity for driving the heaters 59 is ensured in the ejection drive circuits 130A.

According to the second adaptation embodiment described above, it is possible to drive the heaters 59 by using the ejection drive circuits 130A which drive the ejection elements 53, without having to provide a separate drive circuit for driving the heaters 59 (the heater drive circuit 130B as shown in FIG. 16, and the like). Moreover, since the switching ICs 120A and 120B are controlled in such a manner that the loads driven by the ejection drive circuits 130A are uniform, then variation in the drive waveform due to load variations between the ejection drive circuits 130A is suppressed, and desirable ink ejection can be performed from all of the nozzles in the head 50.

The aforementioned embodiments are described with respect to an inkjet recording apparatus used for color printing by means of a plurality of colors of ink, but the present invention may also be applied to an inkjet recording apparatus used for monochrome printing.

Moreover, in the foregoing explanation, an inkjet recording apparatus is described as one embodiment of an image forming apparatus, but the scope of application of the present invention is not limited to this. For example, the drive apparatus of the liquid ejection head and the liquid ejection apparatus according to the present invention may also be applied to a photographic image forming apparatus in which developing solution is applied to a printing paper by means of a non-contact method. Furthermore, the scope of application of the driving apparatus for the liquid ejection head and the liquid ejection apparatus according to the present invention is not limited to an image forming apparatus, and the present invention may also be applied to various other types of apparatuses which spray a processing liquid, or other liquid, toward an ejection receiving medium by means of a liquid ejection head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head including, a plurality of ejection elements arranged in a matrix of ejection elements with the plurality of ejection elements extending in a row direction of the matrix of ejection elements coinciding with a main scanning direction and in a column direction of the matrix of ejection elements which is substantially parallel to a sub-scanning direction, each of the ejection elements having a nozzle which ejects liquid onto an ejection receiving medium and having a piezoelectric element which applies an ejection force to the liquid to be ejected from the nozzle, the ejection elements forming columnar groups of the ejection elements, with each of the columnar groups of the ejection elements being constituted by the ejection elements arranged to extend in the column direction, and a plurality of heating elements which heat the liquid to be ejected from the nozzles, each of the heating elements being arranged in the row direction correspondingly to each one of the columnar groups of the ejection elements that extend in the column direction, each of the heating elements having a length in the column direction of the matrix of ejection elements substantially equal to or greater than a length of each of the columnar groups of the ejection elements;

a movement device which moves the ejection receiving medium in the sub-scanning direction relatively to the liquid ejection head by moving at least one of the ejection receiving medium and the liquid ejection head;

a heating element drive device which applies a heating drive signal to each of the heating elements;

a prediction device which predicts a number of the ejection elements to be driven in each of the columnar groups of the ejection elements according to ejection data; and a heating control device which varies and controls an amount of heat generated by each of the heating elements according to the number of the ejection elements to be driven in each of the columnar groups of the ejection elements as predicted by the prediction device without an input from a temperature measuring sensor to indicate a measured temperature.

2. The liquid ejection apparatus as defined in claim 1, further comprising:

a temperature setting device which sets a target temperature of the liquid ejected from the nozzles, wherein the heating control device controls the heating elements in such a manner that a temperature of the liquid ejected from the nozzles becomes the target temperature set by the temperature setting device.

3. The liquid apparatus as defined in claim 1, wherein the heating control device controls the heating elements in such a manner that the amount of heat generated by each of the heating elements disposed in end regions of the liquid ejection head in the row direction is greater than the amount of heat generated by each of the heating elements disposed in an approximate center region of the liquid ejection head.

4. The liquid ejection apparatus as defined in claim 1, further comprising:

a temperature distribution prediction device which predicts a temperature distribution in the liquid ejection head, wherein the heating control device controls the heating elements in such a manner that the temperature distribution prediction by the temperature distribution prediction device is compensated.

5. The liquid ejection apparatus as defined in claim 1, wherein:

the heating drive signal includes a common heating drive signal which contains a plurality of types of heating waveform components corresponding to different amounts of heat generated by the heating elements; and the liquid ejection apparatus further comprises a heating drive selection device which selectively applies, from the heating element drive device to each of the heating elements which is to generate the amount of heat, at least one of the heating waveform components of the common heating drive signal corresponding to the amount of heat to be generated by each of the heating elements.

6. The liquid ejection apparatus as defined in claim 5, further comprising:

an ejection element drive device which applies a common ejection drive signal including a plurality of types of ejection waveform components for ejecting ink droplets of a plurality of different volumes, to the election elements; and an ejection drive selection device which selectively applies at least one of the ejection waveform components of the common ejection drive signal, to the ejection elements which are to perform ejection, of the plurality of ejection elements, wherein at least a portion of the common ejection drive signal also serves as the common heating drive signal, and the ejection element drive device applies the common ejection drive signal serving as the common heating drive signal to the heating elements through the heating drive selection device.

7. The liquid ejection apparatus as defined in claim 6, wherein the heating control device controls the heating drive selection device in such a manner that, if the number of the ejection elements to be driven by the ejection element drive device is less than a prescribed reference number of driven elements, a drive capacity corresponding to a differential between the prescribed reference number of driven elements and the number of the ejection elements to be driven by the ejection element drive device is applied to the heating elements from the ejection element drive device, as the common ejection drive signal.

8. The liquid ejection apparatus as defined in claim 6, wherein the ejection element drive device also serves as the heating drive device.

9. A liquid ejection apparatus, comprising:

a liquid ejection head including, a plurality of ejection elements arranged in a matrix of ejection elements with the plurality of ejection elements extending in a row direction of the matrix of ejection elements coinciding with a lengthwise direction of the liquid ejection head and in a column direction of the matrix of ejection elements which is substantially parallel to a breadthways direction of the liquid ejection head, each of the ejection elements having a nozzle which ejects liquid onto an ejection receiving medium and having a piezoelectric element which applies an ejection force to the liquid to be ejected from the nozzle, the ejection elements forming columnar groups of the ejection elements, with each of the columnar groups of the ejection elements being constituted by the ejection elements arranged to extend in the column direction, and a plurality of heating elements which heat the liquid to be ejected from the nozzles, each of the heating elements being arranged in the row direction correspondingly to each one of the columnar groups of the ejection elements that extend in the column direction, each of the heating elements having a length in the column direction of the matrix of ejection elements substantially equal to or greater than a length of each of the columnar groups of the ejection elements;

a movement device which moves the ejection receiving medium in the breadthways direction of the liquid ejection head relatively to the liquid ejection head by moving at least one of the ejection receiving medium and the liquid ejection head;

a heating element drive device which applies a heating drive signal to each of the heating elements;

a prediction device which predicts a number of the ejection elements to be driven in each of the columnar groups of the ejection elements according to ejection data; and a heating control device which varies and controls an amount of heat generated by each of the heating elements according to the number of the ejection elements to be driven in each of the columnar groups of the ejection elements as predicted by the prediction device without an input from a temperature measuring sensor to indicate a measured temperature.

10. The liquid ejection apparatus as defined in claim 9, wherein:

the liquid ejection head is of a full line type;

the row direction of the matrix of ejection elements coincides with a main scanning direction; and the column direction of the matrix of ejection elements is inclined at a fixed angle with respect to a sub-scanning direction.

* * * * *